US005624778A

United States Patent [19]

Sato et al.

[11] Patent Number: 5,624,778

[45] Date of Patent: Apr. 29, 1997

[54] CARRIER FOR ELECTROPHOTOGRAPHY, AND TWO-COMPONENT TYPE DEVELOPER HAVING THE CARRIER

[75] Inventors: Yukoh Sato, Kawasaki; Shinya Mayama, Yamato, both of Japan

[73] Assignee: Canon Kabushiki Kaisha, Tokyo, Japan

[21] Appl. No.: 264,346

[22] Filed: Jun. 23, 1994

[30] Foreign Application Priority Data

Jun. 24, 1993 [JP] Japan ..... 5-175862

[51] Int. Cl.[6] ..... G03G 9/107; G03G 9/113

[52] U.S. Cl. ..... 430/106.6; 430/108; 430/111

[58] Field of Search ..... 430/106.6, 108, 430/111; 428/402, 407

[56] References Cited

U.S. PATENT DOCUMENTS

| | | | |
|---|---|---|---|
| 3,694,359 | 9/1972 | Merrill et al. | 430/106 |
| 4,078,930 | 3/1978 | Mammino et al. | 430/106 |
| 5,376,489 | 12/1994 | Yabe et al. | 430/106.6 |

FOREIGN PATENT DOCUMENTS

| | | | |
|---|---|---|---|
| 0308952 | 3/1989 | European Pat. Off. . | |
| 48-64199 | 9/1973 | Japan . | |
| 59-157657 | 9/1984 | Japan . | |
| 61-9659 | 1/1986 | Japan . | |
| 2-22671 | 1/1990 | Japan . | |
| 2-239255 | 9/1990 | Japan . | |
| 2-239256 | 9/1990 | Japan | 430/108 |

OTHER PUBLICATIONS

Patent & Trademark English Language Translation of Japanese Patent 2–239255 (Pub Sep. 1990).

Database WPI, Week 9217, Derwent Public., AN–92–136134 [17] of JPA 4–070858 (Mar. 5, 1992).

*Primary Examiner*—Janis L. Dote

*Attorney, Agent, or Firm*—Fitzpatrick, Cella, Harper & Scinto

[57] ABSTRACT

The present invention discloses a carrier for use in electrophotography and a two-component type developer for developing an electrostatic image comprising a toner and the carrier. The carrier has magnetic material and a resin. The resin has a polycarbonate resin having a crystallinity of 0.25 or less.

26 Claims, 2 Drawing Sheets

CARRIER FOR ELECTROPHOTOGRAPHY, AND TWO-COMPONENT TYPE DEVELOPER HAVING THE CARRIER

BACKGROUND OF THE INVENTION

1. Field of the Invention

This invention relates to a carrier for electrophotography. This invention also relates to a two-component type developer for developing electrostatic images that comprises the carrier and a toner.

2. Related Background Art

In general, in electrostatic recording systems making use of electrophotography, commonly employed is a method in which a photoconductive material such as selenium, OPC (organic photoconductive material) or α-Si is used in a photosensitive member, where the photosensitive member is uniformly charged by various means, thereafter the charged surface of the photosensitive member is irradiated with a light image to form on its surface an electrostatic latent image corresponding to the light image, and the latent image is converted to a visible image by causing toner to adhere thereto by magnetic brush development or other developing process.

This developing method makes use of a toner that converts the electrostatic latent image to a visible image and carrier particles comprising a magnetic material. The carrier particles provide a proper quantity of positive or negative electrostatic charges to the toner by triboelectric charging, and also carry the toner on the carrier particle surfaces by the electrostatic attraction force of the triboelectric charges.

The two-component type developer having such a toner and a carrier is coated on a developing sleeve provided with a magnet in its inside, in a given layer thickness by means of a developer layer thickness control member, and then transported to a developing zone formed between the photosensitive member described above and the developing sleeve.

A Given development bias voltage is applied across the photosensitive member and the developing sleeve. The toner is fed to the developing zone and transferred onto the photosensitive member.

There are various performances required in carriers. Particularly important performances are proper triboelectric charge-providing properties, breakdown strength against applied electric fields, impact resistance, wear resistance, anti-spent properties, developing performance and productivity.

For example, long-term use of the two-component type developer causes toner filming in which the toner that contributes no development (i.e, spent toner) melt-adheres to the surface of carrier particles, which consequently causes a deterioration of the two-component type developer and also causes a deterioration of image quality of developed images that is accompanied with it.

An excessively large true specific gravity commonly results in an increase in the load applied to the developer when the developer is made to have a given layer thickness on the developing sleeve by means of the developer layer thickness control member or when the developer is agitated in the developing assembly. Hence, (a) toner filming, (b) carrier break and (c) deterioration of toner tend to occur during the long-term use of the developer, so that the developer tends to deteriorate, accompanied with the deterioration of image quality of developed images.

An increase in particle size of the carrier also commonly results in an increase in the load applied to the developer and hence the above (a) to (c) are more likely to occur, so that the developer tends to deteriorate. It also brings about (d) a poor fine-line reproduction of the developed images, resulting in a poor developing performance.

Thus, the carriers that tend to cause the above (a) to (c) make it necessary to take troubles to periodically change developers, and are enconomically disadvantageous. It is necessary to decrease the load applied to the developer or improve impact resistance and anti-spent properties of carriers so that the above (a) to (c) can be prevented so as to make the lifetime of developers longer.

To cope with the problem on developing performance as noted in the above (d), it is necessary to make the particle size of carriers smaller.

To cope with the problems (a) to (d), a small particle size carrier comprising a binder resin and magnetic particles dispersed therein may be used, as exemplified by a magnetic material dispersed type small particle size carrier prepared by pulverization, as disclosed in Japanese Patent Application Laid-open No. 54-66134.

A magnetic material dispersed type small particle size carrier prepared by polymerization may also be used, as disclosed in Japanese Patent Application Laid-open No. 61-9659.

However, unless a large quantity of magnetic material is added to carrier particles, the above magnetic material dispersed type small particle size carriers have so small a saturated magnetization for their particle size that they have a problem of (e) adhesion of carrier to photosensitive members, which may occur during development. This makes it necessary to replenish the developer or provide in an image forming apparatus a mechanism for collecting adhered carriers. Thus, there cannot be drastic countermeasures for making the lifetime of developers longer.

In the case when a large quantity of magnetic material is added to the magnetic material dispersed type small particle size carriers, the quantity of the magnetic material increases with respect to the binder resin and hence the impact resistance becomes weak. This tends to cause falling-off of the magnetic material from the carrier particles when the developer is made to have a given layer thickness on the sleeve by means of the developer layer thickness control member. As a result, the developer tends to deteriorate. Thus, also in this case, these measures cannot be used as drastic countermeasures for making the lifetime of developers longer.

In the case when a large quantity of magnetic material is added to the magnetic material dispersed type small particle size carriers, resistance of the carrier decreases because of an increase in the quantity of a magnetic material having a low resistance. As a result, they tend to cause (f) faulty images because of a leak of the bias voltage applied during development.

To cope with such problems, a technique in which a magnetic powder is dispersed in a polyester resin is proposed, as disclosed in Japanese Patent Application Laid-open No. 59-157657. The polyester resin, however, has a problem. It commonly has so high a moisture absorption that its properties to provide charges to toner may greatly vary because of influences of temperature and humidity, when used as binders of carriers.

Use of a polyamide resin as a binder resin is disclosed in Japanese Patent Application Laid-open No. 2-22671. The polyamide resin has also a problem. It has relatively so large a surface energy that it can not bring about a satisfactory anti-spent properties, and also greatly tends to cause agglomeration of the carrier itself that it may bring about poor blending properties to toner, resulting in an unstable image density.

Meanwhile, in order to prevent carrier particles from filming on their surfaces, it has been proposed to coat carrier particle surfaces with a resin of various kinds. Such a method, however, is sought to be further improved.

For example, carrier particles coated with a fluorine resin such as a copolymer comprising ethylene tetrafluoride, where the resin has a low critical surface tension, may be filmed with toner with difficulty. The fluorine resin, however, has so poor film-forming properties that it is difficult for carrier core particles to be well uniformly covered therewith thereby making it hard to achieve a stable charge performance. The fluorine resin may also weakly adhere to core particles and can provide only a poor wear resistance. Moreover, because of a relation with the triboelectric series, the fluorine resin-coated carrier particles can not have a satisfactory charge performance in the case of negatively chargeable toners.

As for carrier particles coated with an acrylic resin such as a styrene/methacrylate copolymer, the resin has good film-forming properties and a strong adhesion to carrier core particles, which also has a superior wear resistance, and is used in combination with the above fluorine resin or alone. This acrylic resin, however, has so relatively high a critical surface tension that the carrier particles still tend to be filmed with toner, bringing about some problem in the lifetime of the developer.

In Japanese Patent Applications Laid-open No. 2-239255 and No. 2-239256, a polycarbonate resin is proposed as the carrier coating resin. When commonly available polycarbonate resins are used as carrier coating materials, the carrier may undergo changes in charge performance as a result of its long-term use, to often cause variations of image density and background stain at non-image areas. These can be caused, e.g., by an insufficient strength of adhesion to carrier core particles in the case of sole use of the polycarbonate resin, which may cause the resin to become separate from the carrier particle surfaces as a result of long-term repeated use, or by a high resistance inherent in the polycarbonate resin, which may cause attraction of external additives of toner to the surfaces of carrier particles, the former being retained on the latter as they are, when the carrier is brought into friction with the toner, resulting in a lowering of its charge-providing performance to the toner.

The problems may also be caused by an unsatisfactory compatibility that may be obtained when a different resin is used in combination in order to improve the adhesion of the polycarbonate resin to the core particles, which rather cause the filming with toner or falling-off of resin from the core particles, where it is difficult for the properties inherent in the polycarbonate resin to be well exhibited.

An improvement in film-forming properties necessarily makes the carrier have a high resistance, and causes charge-up of toner to bring about poor separation of the toner from the carrier.

Moreover, when development is carried out for a long time in the state the toner has thus become poorly separable from the carrier, the aforesaid filming of carrier with toner may be promoted to bring about undersirable results.

If a carrier has an excessively high resistance, the carrier may cause a decrease in image density and a deterioration of halftone reproduction at solid areas, or may adhere to a photosensitive member to cause scratches of the photosensitive member and also may adhere onto images.

Thus, it is very important not to damage film-forming properties of coating materials while controlling the resistance on carrier particle surfaces.

SUMMARY OF THE INVENTION

An object of the present invention is to provide a carrier for electrophotography that has solved the problems discussed above.

Another object of the present invention is to provide, in two-component type development systems, a carrier for electrophotography that requires no replenishment of carrier during its continuous use and also gives a superior developing performance and developer lifetime because of the stabilization of chargeability of toner during continuous use and under variations of humidity.

Still another object of the present invention is to provide a carrier for electrophotography that has been improved in its impact resistance and its stability of charge-providing performance to toner, and a magnetic carrier having superior developing performance and developer durability.

A further object of the present invention is to provide a resin-coated carrier that may cause less deterioration of toner and can be highly durable.

A still further object of the present invention is to provide a carrier that may cause less variations of triboelectric charge performance and can give images that are very stable over a long period of time, using a coating resin having a satisfactory mechanical strength against wear, impact and so forth.

A still further object of the present invention is to provide a two-component type developer having a toner and the above carrier.

The present invention provides a carrier for use in electrophotography, comprising a magnetic material and a resin;

said resin comprising a polycarbonate resin having a crystallinity of 0.25 or less.

The present invention also provides a two-component type developer for developing an electrostatic image, comprising a toner and a carrier; said carrier comprising a magnetic material and a resin;

said resin comprising a polycarbonate resin having a crystallinity of 0.25 or less.

The present invention provides a carrier for use in electrophotography, comprising a magnetic material and a resin;

said resin comprising a polycarbonate-polydiorganosiloxane block copolymer represented by the formula:

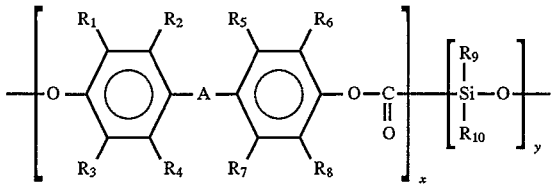

wherein x and y each represent a copolymerization weight ratio; $R_1$ to $R_8$ each independently represent a hydrogen atom, a halogen atom or a lower alkyl group; $R_9$ and $R_{10}$ each independently represents an alkyl group having 1 to 3 carbon atoms or a phenyl group; and A represents —O—, —S—, —CO—, —$SO_2$—, an alkylidene group or a cyclic alkylidene group.

The present invention also provides a two-component type developer for developing an electrostatic image, comprising a toner and a carrier; said carrier comprising a magnetic material and a resin;

said resin comprising a polycarbonate-polydiorganosiloxane block copolymer represented by the formula:

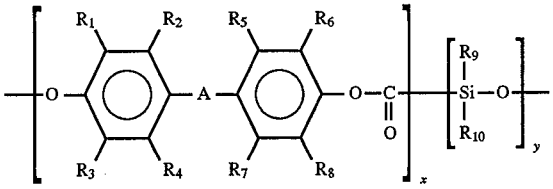

wherein x and y each represent a copolymerization weight ratio; $R_1$ to $R_8$ each independently represent a hydrogen atom, a halogen atom or a lower alkyl group; $R_9$ and $R_{10}$ each independently represent an alkyl group having 1 to 3 carbon atoms or a phenyl group; and A represents —O—, —S—, —CO—, —$SO_2$—, an alkylidene group or a cyclic alkylidene group.

DESCRIPTION OF THE PREFERRED EMBODIMENTS

Figure 1:
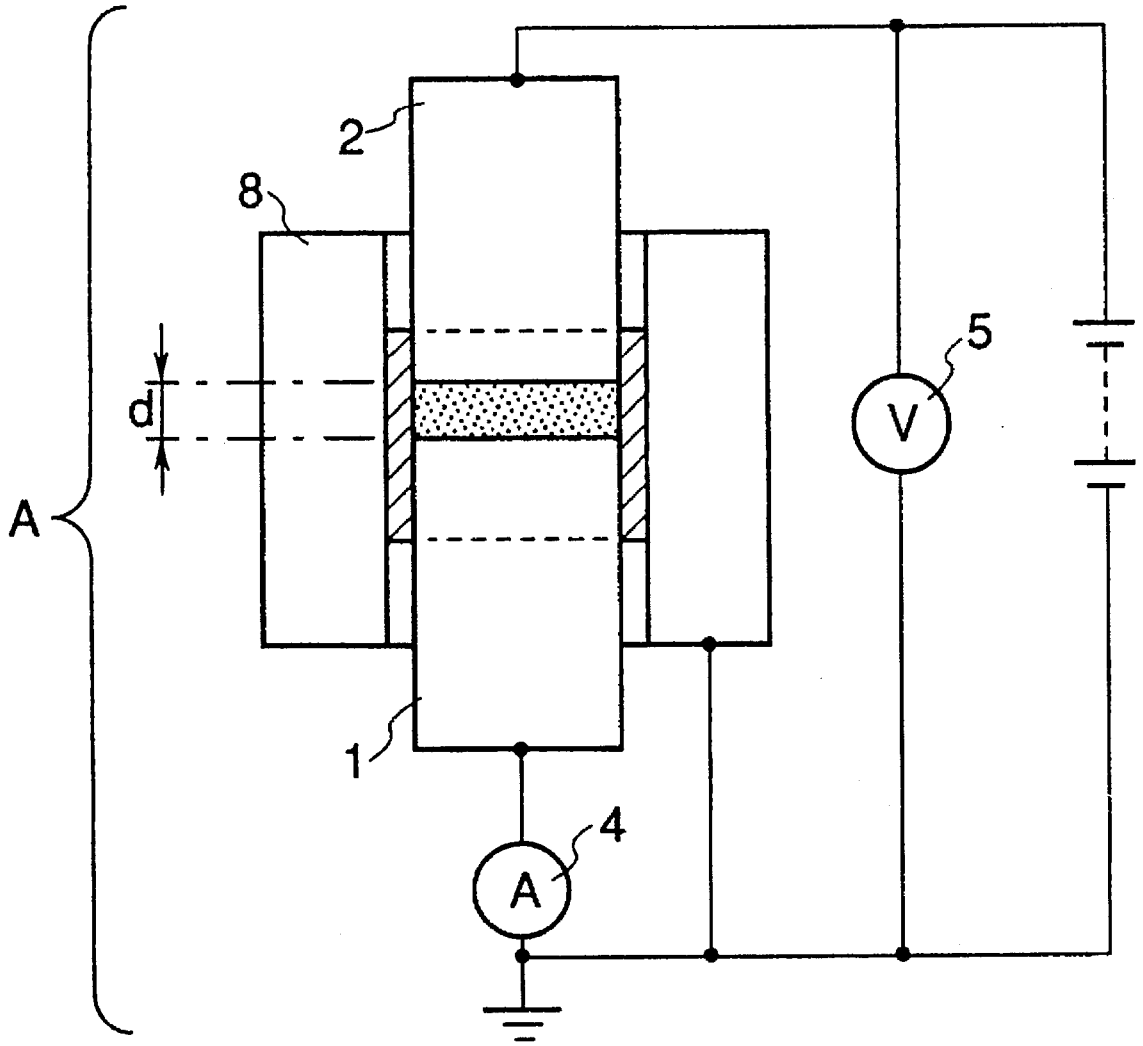
FIG. 1 is a schematic view to diagrammatically illustrate an apparatus for measuring specific resistance of carriers.

Improvements in properties of the carrier of the present invention are presumed to be brought about for the following reasons: In magnetic material dispersed type carriers comprised of fine magnetic material particles and a binder resin, there is commonly a certain limit to the amount in which the fine magnetic material particles can be dispersed in the binder resin. If the fine magnetic material particles are dispersed in an insufficient amount, no magnetic force strong enough to prevent the carrier from adhering to the surface of a photosensitive member can be obtained. If on the other hand the amount in which the fine magnetic material particles are dispersed is increased in order to achieve a higher magnetic force and stop the carrier adhesion, the carrier itself becomes so brittle that it may be pulverized in a developing assembly as a result of a friction between the toner and the carrier or an impact between carrier particles, or the fine magnetic material particles may fall off from the carrier particle surfaces and participate in development together with the toner to cause image stain.

Accordingly, what is preferable is a carrier that may cause no carrier adhesion and have a sufficient strength, and the present inventors made extensive studies. As a result, it has become possible to obtain a magnetic material dispersed type carrier having superior mechanical strength and also superior magnetic properties, when a specific polycarbonate or polycarbonate-polyorganosiloxane block copolymer resin is used as the binder resin.

When the specific polycarbonate resin is used as a binder resin for the magnetic material dispersed type carrier, the amount in which the fine magnetic material particles can be dispersed can be made larger than in the case where conventional usual resins are used, and hence both a sufficient strength and superior magnetic properties can be satisfied at the same time. Also, because of a small moisture absorption of the polycarbonate resin, its use in the carrier makes it possible to stably provide the toner with charges without regard to changes in temperature and humidity of environments. In addition, because of a magnetic material dispersed type carrier with a low specific gravity, the carrier can have a small shear to the developer in a developing assembly, so that the deterioration of carrier such as filming with toner and carrier break can be lessened and stable charge-providing properties and good developing performance can be achieved over a long period of time. Furthermore, the use of a carrier having a crystallinity of 0.25 or less, and preferably 0.20 or less, can achieve an improvement in anti-spent properties, can bring about properties of stably providing toner with charges over a long period of time, and can make the lifetime of the developer longer.

As the carrier resin used in the present invention, the polycarbonate resin may be used alone or in combination with at least one of different kinds of resins.

The polycarbonate resin is a resin represented by the formula:

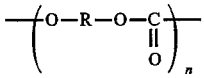

wherein R represents an organic group, and n represents a degree of polymerization. In usual instances, it can be produced using a dihydric phenol and according to a known synthesis process as exemplified by the following.

(a) Synthesis reaction carried out using phosgene.

(b) Synthesis reaction carried our using a bischloroformate of a compound represented by the following formula (I) or (II).

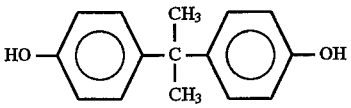

(I)

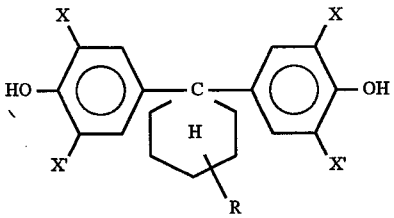

(II)

wherein X and X' each represent a hydrogen atom, a halogen atom or a methyl group; R represents a hydrogen atom, a halogen atom, a hydroxyl group, a carboxyl group, an acetyl group or an alkyl group having 1 to 4 carbon atoms.

(c) Synthesis reaction carried out using a monochloroformate of the compound represented by the above formula (I) or (II).

(d) Synthesis reaction carried out using a carbonic acid diester.

(e) Synthesis reaction carried out using a biscarbonate of the compound represented by the above formula (I) or (II).

(f) Synthesis reaction carried out using a monocarbonate of the compound represented by the above formula (I) or (II).

To attain the crystallinity of 0.25 or less, it is preferable to incorporate into the polymer chain a structural unit that inhibits crystallizability.

The polycarbonate resin used in the present invention may include homopolymers or copolymers making use of any of the following compounds as the dihydric phenol. Copolymers obtained using any of these dihydric phenols and bisphenol-A can also be effectively used. Dihydric phenols other than those exemplified herein may also be used.

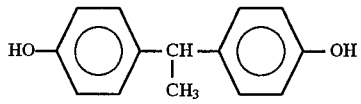
Compound (1)

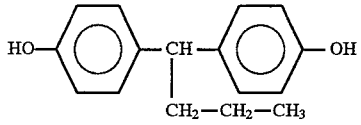
Compound (2)

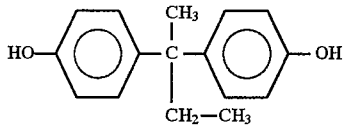
Compound (3)

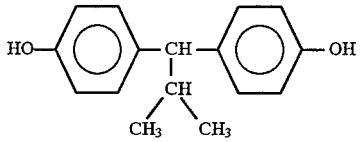
Compound (4)

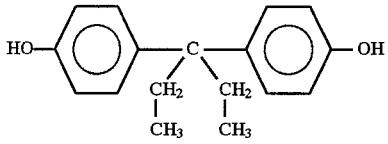
Compound (5)

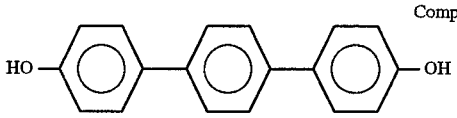
Compound (6)

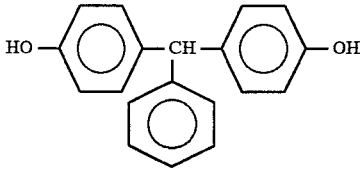
Compound (7)

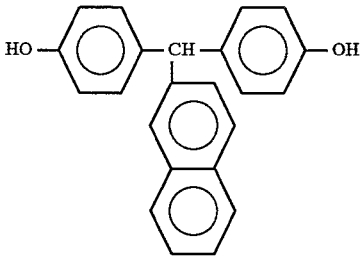
Compound (8)

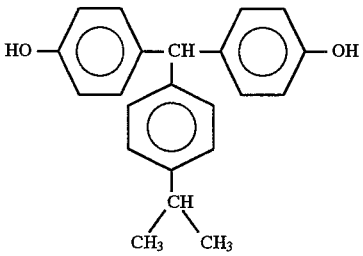
Compound (9)

-continued

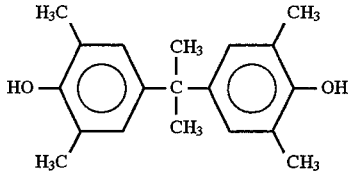
Compound (10)

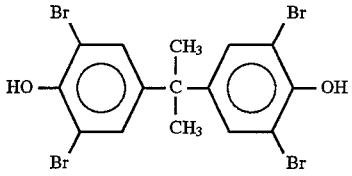
Compound (11)

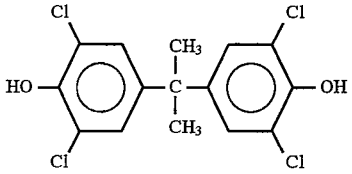
Compound (12)

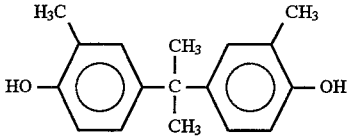
Compound (13)

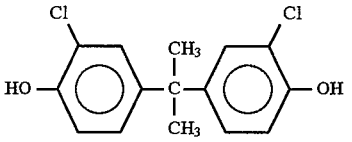
Compound (14)

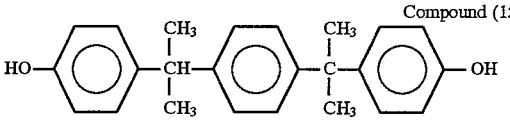
Compound (15)

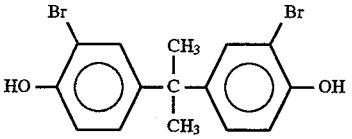
Compound (16)

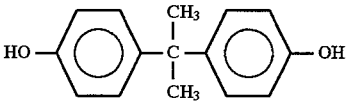
Compound (17)

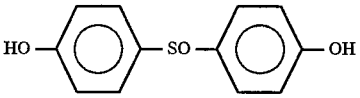
Compound (18)

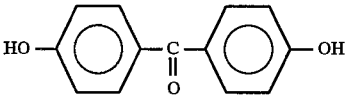
Compound (19)

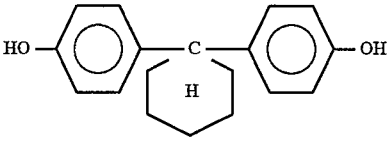
Compound (20)

-continued
Compound (21)
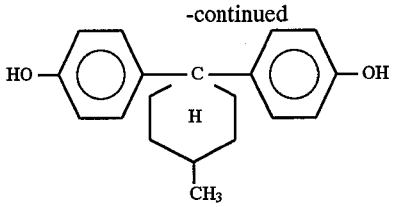
Compound (22)
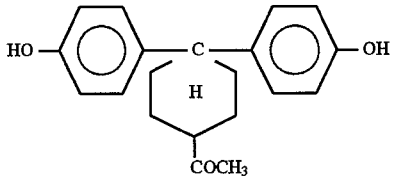
Compound (23)
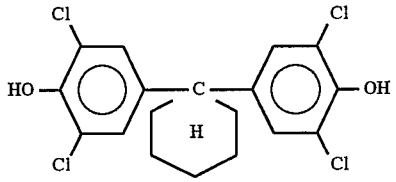
Compound (24)
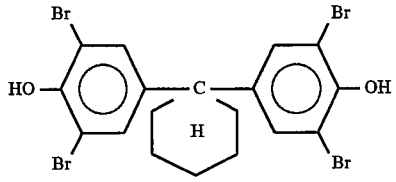
Compound (25)
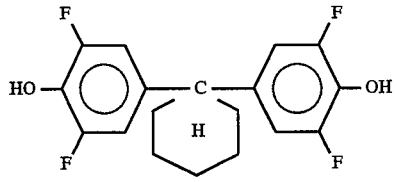
Compound (26)
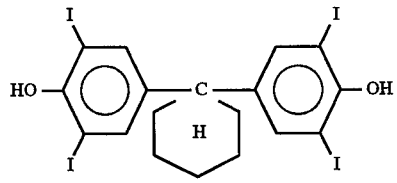
Compound (27)
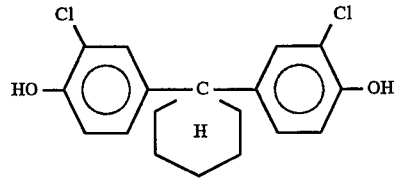
Compound (28)
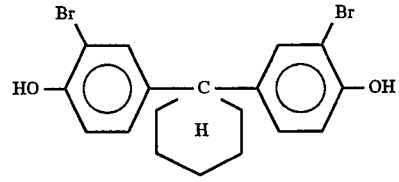
Compound (29)
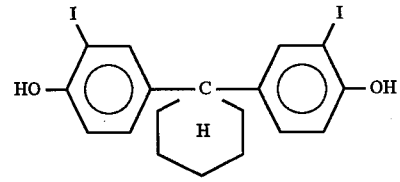
-continued
Compound (30)
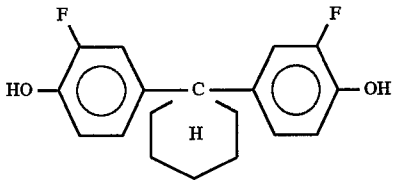
Compound (31)
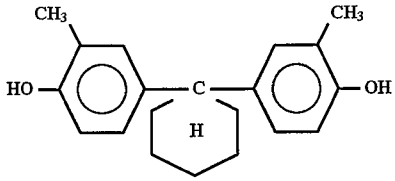
Compound (32)
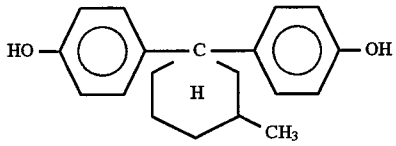
Compound (33)
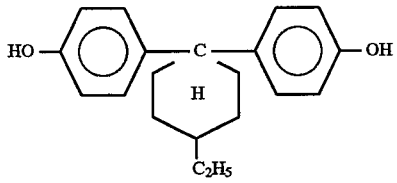
Compound (34)
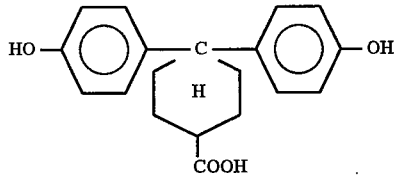
Compound (35)
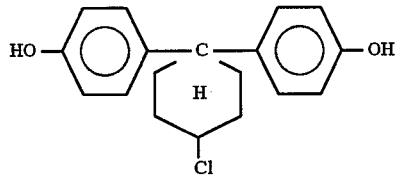
Compound (36)
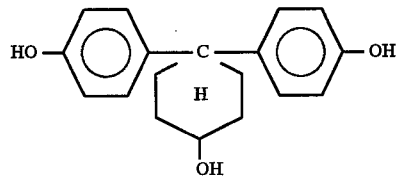
Compound (37)
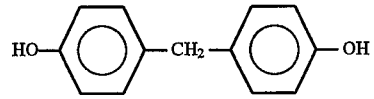
Compound (38)
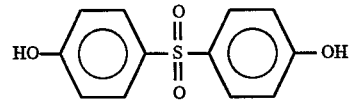
Compound (39)
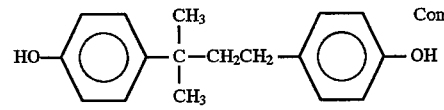

-continued

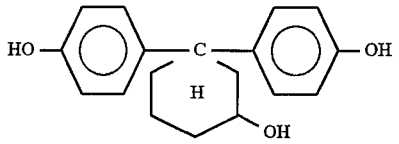

Compound (40)

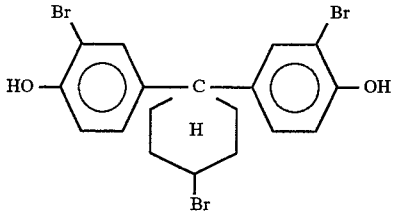

Compound (41)

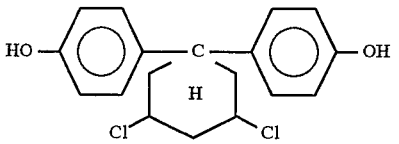

Compound (42)

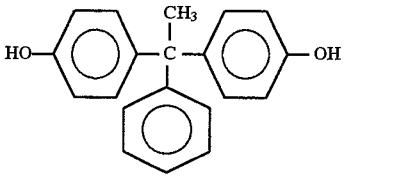

Compound (43)

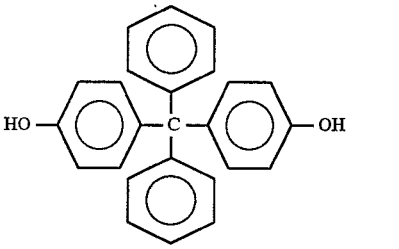

Compound (44)

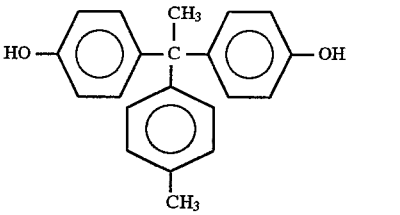

Compound (45)

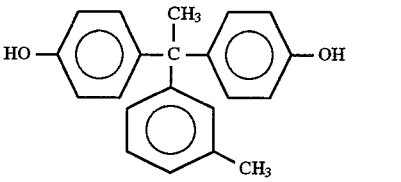

Compound (46)

In particular, the polycarbonate resin may preferably be a resin having the following structural unit of (IIa) or (IIIa).

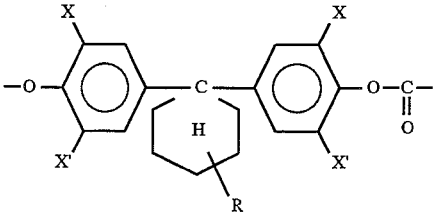

(IIa)

wherein X and X' each represent a hydrogen atom, a halogen atom or a methyl group; R represents a hydrogen atom, a halogen atom, a hydroxyl group, a carboxyl group, an acetyl group or an alkyl group having 1 to 4 carbon atoms.

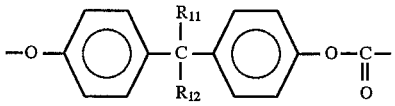

(IIIa)

wherein $R_{11}$ and $R_{12}$ are different from each other and represents an alkyl group or an aromatic group.

Stated specifically, a polycarbonate resin having any of the following structural units is preferred.

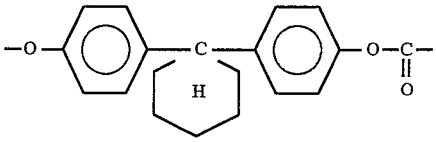

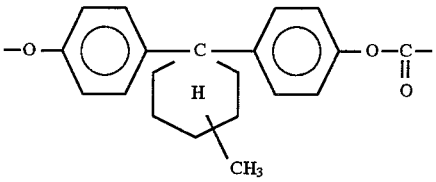

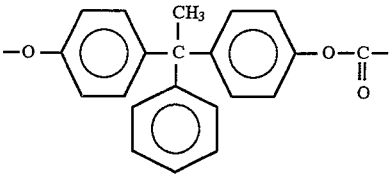

The polycarbonate resin may more preferably be a copolymer having the following two kinds of component units;

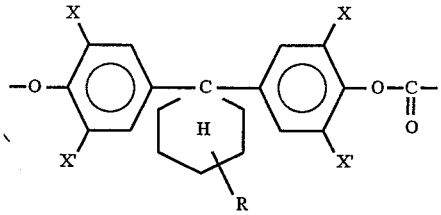

(IIa)

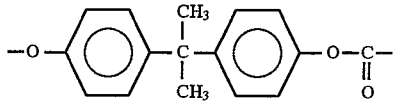

or a copolymer having the following two kinds of component units;

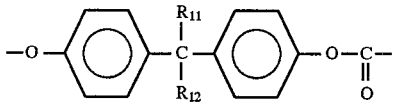

(IIIa)

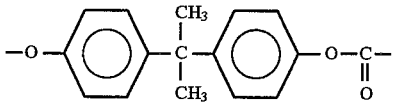

Stated specifically, the polycarbonate resin may preferably be a copolymer having the following two kinds of component units;

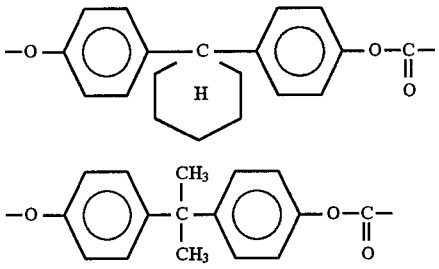

or a copolymer having the following two kinds of component units;

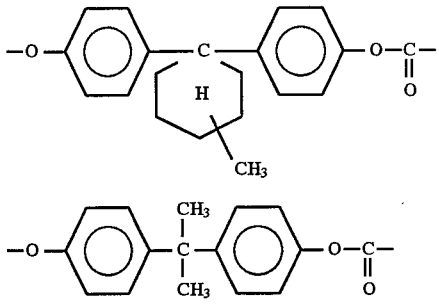

or a copolymer having the following two kinds of component units;

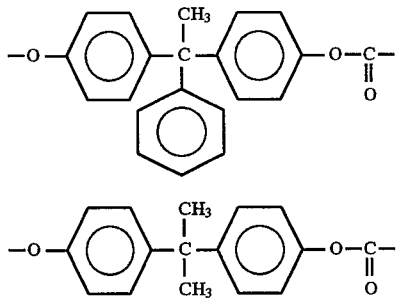

The polycarbonate resin may preferably have a weight average molecular weight (Mw) of from 10,000 to 50,000. The polycarbonate resin may further preferably have a glass transition point of from 100° C. to 200° C., and more preferably from 120° C. to 180° C.

The present inventors have discovered that it is also preferable to use as the resin a polycarbonate-polydiorganosiloxane block copolymer represented by the following Formula (III):

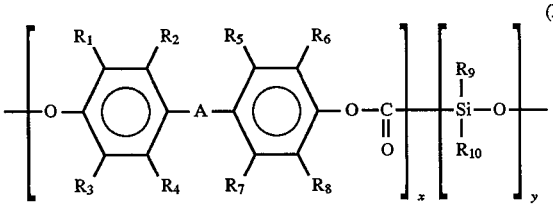

(III)

wherein x and y each represent a copolymerization weight ratio; $R_1$ to $R_8$ each independently represent a hydrogen atom, a halogen atom or a lower alkyl group; $R_9$ and $R_{10}$ each independently represent an alkyl group having 1 to 3 carbon atoms or a phenyl group; and A represents —O—, —S—, —CO—, —$SO_2$—, an alkylidene group or a cyclic alkylidene group.

The polycarbonate-polyorganosiloxane block copolymer may more preferably have a crystallinity of 0.25 or less.

This can solve the problems on wear resistance and on triboelectric charge performance during long-term running that are caused especially when the magnetic material has been added in a large quantity in order to improve magnetic properties of the magnetic material dispersed type carrier. When the resin is used as a carrier coating resin, the incorporation of polydialkylsiloxane structural units provides surface lubricity while maintaining impact resistance and brings about an improvement in releasability of carrier coatings, so that the lifetime of the carrier can be greatly prevented from becoming short because of the filming with toner.

With regard to x and y in Formula (III), the ratio x/(x+y) may preferably be in the range of 0.25 to 0.99 from the viewpoint of physical properties such as mechanical strength and impact resistance of the copolymer. If this ratio is smaller than 0.25, the mechanical strength tends to become less, thereby causing decrease in durability. If it is more than 0.99, the charge performance tends to decrease when the carrier is repeatedly used.

The block polycarbonate resin represented by Formula (III) may preferably have a molecular weight ranging from 10,000 to 50,000 as weight average molecular weight (Mw). If this resin has a weight average molecular weight smaller than 10,000, its durability tends to deteriorate. If it has a weight average molecular weight larger than 50,000, its viscosity becomes so high when heat-kneaded, to make it difficult to carry out melt-kneading. The block polycarbonate resin can be produced, for example, by the method disclosed in Japanese Patent Application Laid-open No. 48-64199.

The polycarbonate-polydiorganosiloxane block copolymer may preferably have a glass transition point ranging from 50° C. to 200° C., and more preferably from 100° C. to 155° C. Use of this block copolymer has made it possible to improve wear resistance properties and anti-filming properties to the toner and also has made it possible to prevent the toner from deteriorating. The reason therefor is presumed to be due to a rich lubricity possessed by the binder resin of the present invention compared with conventional binder resins, which consequently brings about an improvement in anti-filming properties to the toner and also a decrease in shear stress against the toner.

Resin that can be used in combination with the polycarbonate resin described above may include resins obtained by polymerizing vinyl monomers. The vinyl monomers herein referred to can be exemplified by styrene, and styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxylstyrene, p-chlorostyrene, 3,4-dichlorostyrene, m-nitrostyrene, o-nitrostyrene or p-nitrostyrene; ethylenes and unsaturated monoolefins such as ethylene, propylene, butylene and isobutylene; unsaturated diolefins such as butadiene and isoprene; vinyl halides such as vinyl chloride, vinylidene chloride, vinyl bromide and vinyl fluoride; vinyl esters such as vinyl acetate, vinyl propionate and vinyl benzoate; methacrylic acid, and α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid, and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid, and maleic half esters; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; vinyl naphthalates; acrylic acid or methacrylic acid derivatives such as acrylonitrile, methacrylonitrile and acrylamide; and acroleins. Polymers obtained using one or more kinds of any of these can be used.

Besides the resins obtained by polymerizing vinyl monomers, it is also possible to use non-vinyl type resins such as polyester resins, epoxy resins, phenol resins, urea resins, polyurethane resins, polyimide resins, cellulose resins and polyether resins, or mixtures of any of these with the vinyl resins described above, as well as praffin waxes.

A block copolymer or graft polymer may also be added as a compatibilizing agent.

The crystallinity of the polycarbonate resin used in the present invention can be measured, for example, in the following way: The resin is dissolved in a resin-soluble solvent and then the solution is casted to be formed into film. The film thus formed is analyzed by X-ray diffraction to calculate the proportion of crystalline regions held in the whole peaks on a chart to determine the crystallinity.

The coating resin applied to the carrier core particles may preferably be in coating weight of from 0.05 to 30% by weight in terms of coating resin solid content. In a coating weight less than 0.05% by weight, the coating effect on carrier core particles may become small. In a coating weight more than 30% by weight, there can be substantially no change in effect, rather tending to cause a cost increase and bad influences due to separated resin components. The weight of the coating resin depends on the true specific gravity of the carrier core particles. Taking this fact into account, when the true specific gravity of the carrier core particles is represented by Z, an optimum value of the coating weight of the coating resin material may preferably be within the range expressed as follows:

$1/2Z \leqq$ resin coating weight $\leqq 50/Z$ (% by weight);

and more preferably;

$1/Z \leqq$ resin coating weight $\leqq 25/Z$ (% by weight).

As magnetic core particles, it is possible to use, for example, particles of ferromagnetic metals such as iron, cobalt and nickel, and compounds or alloys containing an element exhibiting ferromagnetic properties, such as iron, cobalt or nickel, as exemplified by ferrite, magnetite and hematite. It is suitable for the core particles to have a particle diameter of from 10 to 1,000 μm, and preferably from 20 to 200 μm.

The magnetic material used in the fine magnetic material particles that constitute the magnetic material dispersed type carrier may include, for example, ferromagnetic metals such as iron, cobalt and nickel, and compounds or alloys containing an element exhibiting ferromagnetic properties, such as iron, cobalt or nickel, as exemplified by ferrite, magnetite and hematite. The fine magnetic material particles may preferably have a saturation magnetization of 60 emu/g or higher under application of a magnetic field of 10 kOe. If the saturation magnetization is lower than 60 emu/g, the carrier tends to adhere to the photosensitive member even if the fine magnetic material particles are in a large content. The magnetic force is measured using, for example, VSM, manufactured by Toei Kogyo K.K.

The fine magnetic material particles may preferably have a primary average particle diameter of 2.0 μm or smaller. If the primary average particle diameter is larger than 2.0 μm, the core particles can have dense surfaces with difficulty and the coatings formed thereon can be uniform with difficulty. The fine magnetic material particles may preferably have a specific resistance of not higher than $10^9$ Ω.cm and may also preferably be contained in an amount of not less than 30% by weight, and more preferably not less than 50% by weight, based on the total weight of the carrier. If they are in an amount less than 30% by weight, the carrier tends to adhere to the photosensitive member.

In the present invention, in the constitution of the above carrier, a charge control agent, a dispersion improver, a coupling agent, a conductive agent and so forth may be added besides the binder resin and the fine magnetic material particles.

The magnetic material dispersed type carrier used may preferably have an average particle diameter ranging from 10 to 60 μm. A carrier with an average particle diameter smaller than 10 μm tends to cause its adhesion to the photosensitive member. A carrier with an average particle diameter larger than 60 μm may apply a large shear to the developer in a developing assembly, tending to cause deterioration of the developer, in particular, separation of external additives from toner particles, and a change in shapes. Moreover, a large particle diameter results in a small specific surface area, and hence the quantity of the toner that can be held as a component for the developer decreases, tending to give images lacking in minuteness. The particle size of the carrier particles is indicated as horizontal direction maximum chord length, and measured by the microscopic method, where 300 or more carrier particles are selected at random, and their diameters are actually measured.

The carrier particles of the present invention may preferably have a true specific gravity ranging from 1.5 to 5.0, and more preferably from 1.5 to 4.5. If its true specific gravity is more than 5.0, a large load may be applied to the developer in a developing assembly, and is not preferable from the viewpoint of deterioration of the developer. If its true specific gravity is less than 1.5, it is difficult to prevent the adhesion of carrier to the photosensitive member. The true specific gravity is measured using, for example, True Denser (manufactured by Seishin Kigyo).

It is suitable for the carrier to have a specific resistance ranging from $10^7$ to $10^{14}$ Ω.cm. If its specific resistance is lower than $10^7$ Ω.cm, electric currents may leak from the sleeve to the surface of the photosensitive member in a developing zone in the case of the development in which a bias voltage is applied, resulting in a difficulty in obtaining good images. If its specific resistance is higher than $10^{14}$ Ω.cm, the charge-up may occur in a low-humidity environment to cause image deterioration such as density decrease, faulty transfer or fogging.

The specific resistance is measured using a measuring method as shown in FIG. 1. A method is used in which a carrier is packed in a cell A and electrodes 1 and 2 are so provided as to come into contact with the packed carrier, where a voltage is applied across the electrodes and the electric currents flowing at that time are measured to determine specific resistance ρ(Ω.cm). Other elements shown in FIG. 1 are a galvanometer 4 and a voltmeter 5. In this measuring method, a change may occur in packing because the carrier is a powder, which may be accompanied with a change in specific resistance, and thus care must be taken. The specific resistance in the present invention is measured under conditions of a contact area S between the packed carrier and the electrodes of about 2.3 $cm^2$, a thickness of about 1 mm, a load of the upper electrode 2 of 275 g, and an applied voltage of 100 V.

The carrier may preferably have a sphericity (major axis/minor axis) of not more than 2. If the sphericity is more than 2, the carrier of the present invention tends to become less effective for decreasing the shear applied to the developer and for improving the fluidity required in developers. Thus, its sphericity may preferably be not more than 2 so that the effects that can be attained by the carrier of the present invention are not damaged, i.e., to prevent deterioration of the developer and to improve developing performance.

The carrier can be made to have the sphericity of not more than 2 by a means including a method in which the core particles are heated to bring their surfaces into heat fusion so as to be formed into spheres, a method in which the core particles are mechanically formed into spheres, and a method in which the core particles are prepared using a conventional suspension polymerization method comprising adding fine magnetic material particles, a polymerization initiator, a suspension stabilizer and so forth in a monomer solution of a binder resin used for the core particles followed by granulation and polymerization to give core particles. Thus, the sphericity of not more than 2 can be achieved without applying the treatment to the core particles.

A process for producing the carrier of the present invention will be described below.

The magnetic material dispersed type carrier can be produce by, e.g., a method in which the binder resin and the fine magnetic material particles are mixed in the desired weight ratio, which are then kneaded at a suitable temperature using a heating melt-mixing apparatus as exemplified by a three-roll mill or an extruder, and, after cooled, the kneaded product is pulverized and classified; a method in which the binder resin is dissolved in a soluble solvent, and the fine magnetic material particles are mixed therein to give a slurry, followed by granulation using a spray dryer and then drying; or a polymerization method in which the fine magnetic material particles, a polymerization initiator, a suspension stabilizer and so forth are added to and dispersed in a monomer solution of the binder resin for the core particles, followed by granulation.

The resin-coated carrier of the present invention can be produced by, e.g., a method in which the core particles are immersed in a coating resin solution prepared by dissolving the coating resin in a suitable solvent, and thereafter the solvent is evaporated using a spray dryer to form resin coatings; or a method in which, while the core particles are fed into a fluidized bed coating apparatus to form a fluidized bed, the coating resin solution is sprayed and concurrently dried to gradually form coatings.

For the purpose of improving adhesion at the interface between the coating resin and the carrier core particles, it is also possible to use silane coupling agents such as methyltrimethoxysilane, methyltriethoxysilane, vinyltriethoxysilane, vinyltris(methoxyethoxysilane), vinyltriacethoxysilane, γ-methacryloxypropyltrimethoxysilane, γ-aminopropyltriethoxysilane, γ-(aminoethyl) aminopropyltriethoxysilane, γ-glyxidoxypropyltriethoxysilane, γ-mercaptopropyltrimethoxysilane, β-(3,4-epoxycyclohexyl)ethyltrimethoxysilane and γ-chloropropyltrimethoxysilane; organic titanium compounds such as tetraisopropyl titanate, a tetraisopropyl titanate polymer, tetrabutyl titanate, a tetrabutyl titanate polymer, tetrastearyl titanate, 2-ethylhexyl titanate, isopropoxytitanium stearate, titanium acetylacetonate and titanium lactate; and organic phosphoric acid type adhesion promotors. The above compounds may each be used alone or may be used in combination of two or more kinds. Also, the carrier core particles may have been treated with any of the above compounds and then may be coated with the carrier coating resin of the present invention. Alternatively, the above adhesion improver may have been mixed in the coating resin and then the mixture may be coated at one time.

A method of measuring the quantity of triboelectricity of the toner, produced by the carrier of the toner, will be described below in detail with reference to FIG. 2.

Figure 2:
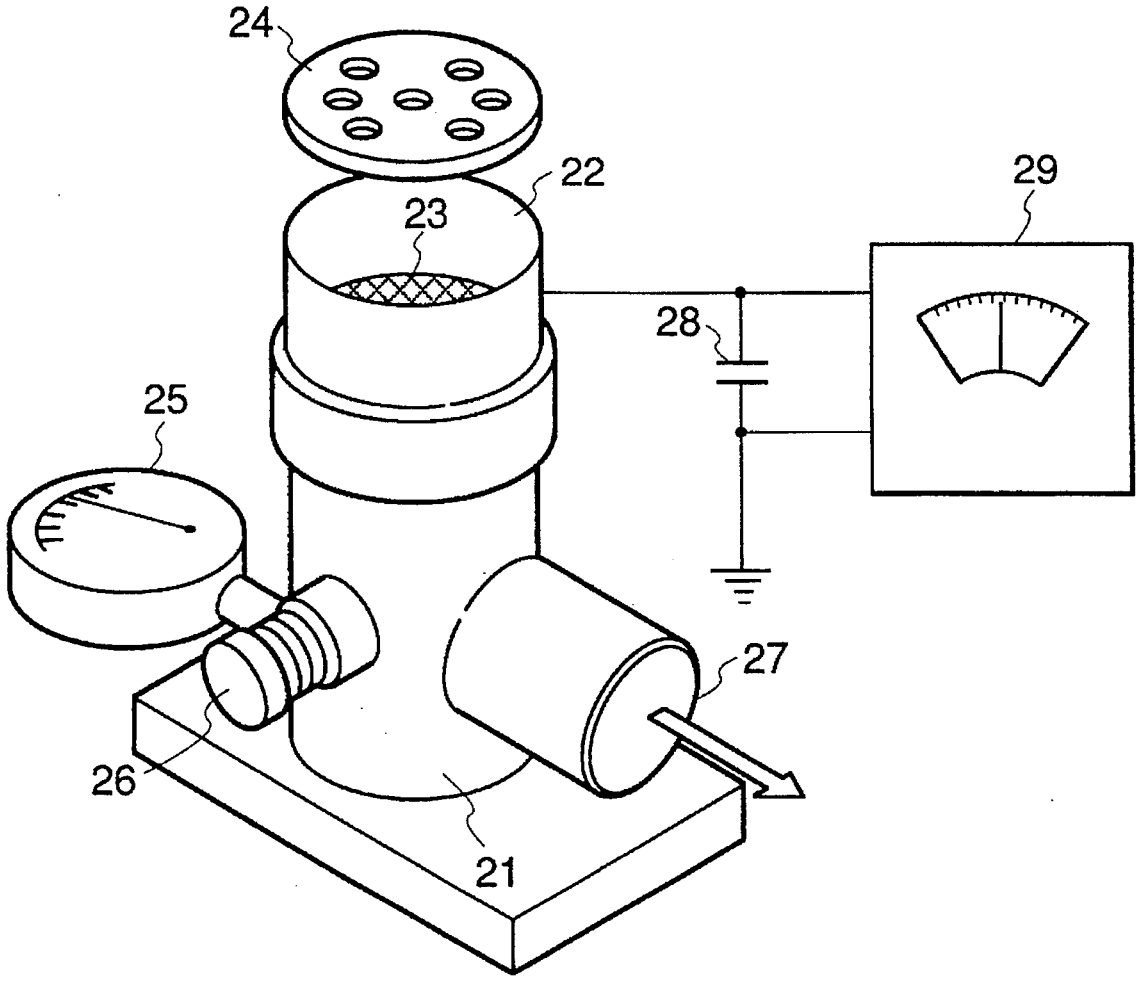
FIG. 2 is a schematic view to diagrammatically illustrate an apparatus for measuring triboelectric charges of toners of two-component type developers.

FIG. 2 illustrates an apparatus for measuring the quantity of triboelectricity. In a measuring container 22 made of a metal at the bottom of which is provided a conducting screen 23 of 500 meshes (appropriately changeable to the size the screen does not pass the carrier particles), a magnetic brush (a mixture of toner and magnetic particles) on a developer carrying member is put and the container is covered with a plate 24 made of a metal. The total weight of the measuring container 22 in this state is weighed and is expressed by $W_1$ (g). Next, in a suction device 21 (made of an insulating material at least at the part coming into contact with the measuring container 22), air is sucked from a suction opening 27 and an air-flow control valve 26 is operated to control the pressure indicated by a vacuum indicator 25 to be 250 mmHg. In this state, suction is sufficiently carried out (for about 1 minute) to remove the toner by suction. The potential indicated by a potentiometer 29 at this time is expressed by V (volt). Reference numeral 28 denotes a condenser, whose capacitance is expressed by C (μF). The total weight of the measuring container after completion of the suction is also weighed and is expressed by $W_2$ (g). The quantity Q (μC/g) of triboelectricity is calculated as shown by the following equation.

$$Q(\mu C/g)=C\times V/(W_1-W_2)$$

The measurement is carried out under conditions of a temperature of 23° C. and a humidity of 65% RH.

The two-component type developer of the present invention may be comprised of the carrier blended in an amount of from 10 to 1,000 parts by weight, and preferably from 30 to 500 parts by weight, based on 10 parts by weight of the toner.

The toner used in the present invention may preferably have a weight average particle diameter of from 1 to 20 μm, and more preferably from 4 to 13 μm.

As the binder resin of the toner used in the present invention, the following toner binder resins can be used in the case where a heat-pressure roller fixing device having an oil applicator is used. Such binder resins may include polystyrene; polymers of styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins.

In a heat-pressure roller fixing system to which little oil is applied, the adhesion of toner to the toner image bearing member is an important problem. Toners capable of being fixed at less heat energy are usually subject to blocking or caking during storage or in a developing assembly and therefore these problems must be taken into account at the same time. Hence, in the case when the heat-pressure roller fixing system to which little oil is applied is used in the present invention, it is more important to select binder resins. Preferable binder resins include cross-linked styrene copolymers or cross-linked polyesters.

Comonomers copolymerizable with styrene monomers in styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters such as vinyl acetate and vinyl benzoate; olefins such as ethylene, propylene and butylene; vinyl ketones such as methyl vinyl ketone and hexyl vinyl ketone; and vinyl ethers such as methyl vinyl ether and ethyl vinyl ether; any of which may be used alone or in combination of two or more.

As a cross-linking agent, compounds mainly having at least two polymerizable double bonds may be used, including, for example, aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three ethylenic double bonds; any of which may be used alone or in the form of a mixture. The cross-linking agent may be used at the time of the synthesis of the binder resin, in an amount of from 0.01% to 10% by weight, and preferably from 0.05% to 5% by weight, on the basis of the binder resin. This is preferable in view of anti-offset properties and fixing performance.

In use of a pressure fixing system, binder resins for pressure-fixing toner can be used, as exemplified by polyethylene, polypropylene, polymethylene, polyurethane elastomers, an ethylene-ethyl acrylate copolymer, an ethylene-vinyl acetate copolymer, ionomer resins, a styrene-butadiene copolymer, a styrene-isoprene copolymer, linear saturated polyesters, and paraffin.

In the toner used in the present invention, a charge control agent may preferably be used by compounding it into toner particles (internal addition) or blending it with toner particles (external addition). The addition of the charge control agent enables control of optimum electrostatic charges in conformity with developing systems, and can make more stable the balance between particle size distribution and charging of the toner. The use of the charge control agent also enables control of preferable charges. A positive charge control agent may include Nigrosine and products modified with a fatty acid metal salt; quaternary ammonium salts such as tributylbenzylammonium 1-hydroxy-4-naphthosulfonate and tetrabutylammonium tetrafluoroborate; organotin compounds such as dibutyltin oxide, dioctyltin oxide, dicyclohexyltin oxide, diorganotin oxide, dibutyltin borate, dioctyltin borate and dicyclohexyltin borate; any of which may be used alone or in combination of two or more kinds. Of these, Nigrosine compounds or quaternary ammonium salts are particularly preferred.

Homopolymers of monomers represented by the following Formula (II);

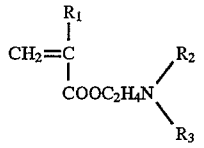

Formula (II)

wherein $R_1$ represents H or $CH_3$; and $R_2$ and $R_3$ each represent a substituted or unsubstituted alkyl group having 1 to 4 carbon atoms; or copolymers of polymerizable monomers such as styrene, acrylates or methacrylates as described above may also be used as positive charge control agents. In this case, the homopolymers or copolymers can also act as binder resins (as a whole or in part).

A negative charge control agent usable in the present invention may include organic metal complexes, organic metal salts and chelate compounds. In particular, acetylacetone metal complexes (including monoalkyl derivatives and dialkyl derivatives), salicylic acid type metal complexes (including monoalkyl derivatives and dialkyl derivatives), or salts thereof are preferred. Salicylic acid type metal complexes or salicylic acid type metal salts are particularly preferred. It may specifically include aluminumacetylacetonato, iron (II) acetylacetonato, a chromium complex or salt of 3,5-di-tert-butylsalicylic acid and a zinc complex or salt of 3,5-di-tert-butylsalicylic acid.

The above charge control agents (those having no action as binder resins) may preferably be used in the form of fine particles. In this case, the charge control agent may preferably have a number average particle diameter of specifically 4 μm or less, and more preferably 3 μm or less.

When internally added to the toner, such a charge control agent may preferably be used in an amount of from 0.1 part to 20 parts by weight, and more preferably from 0.2 part to 10 parts by weight, based on 100 parts by weight of the binder resin.

Fine silica powder may preferably be added to the developer used in the present invention. Combination of the toner and fine silica powder brings about a remarkable decrease in wear because of interposition of fine silica powder between toner particles and carrier. This enables achievement of a longer lifetime of the toner and the carrier and also maintenance of stable charge performance, making it possible to provide a much superior two-component type developer having toner and carrier even in its use for a long period of time.

In particular, in the case of a toner with a weight average particle diameter of 10 μm or less, its BET specific surface area per unit weight may become larger than that of a toner with a weight average particle diameter of more than 10 μm. Thus, when the carrier is brought into contact with toner particles to carry out triboelectric charging, the number of time of contact between toner particle surfaces and carrier becomes larger than in the latter toner with a weight average particle diameter of more than 10 μm, so that the contamination of carrier tends to occur. In such a case, the addition of fine silica powder makes it possible to provide superior two-component type developer as stated above.

As the fine silica powder, both of fine silica powder produced by the dry process and that produced by the wet process can be used. In view of anti-filming and durability, it is preferred to use the dry process fine silica powder.

The dry process herein referred to is a process for producing fine silica powder formed by vapor phase oxidation of, for example, a silicon halide compound.

As for a method in which the fine silica powder used in the present invention is produced by the wet process, conventionally known various methods can be applied.

In the fine silica powder herein referred to, anhydrous silicon dioxide (colloidal silica) or a silicate such as aluminum silicate, sodium silicate, potassium silicate, magnesium silicate or zinc silicate can be applied.

Of the above fine silica powders, a fine silica powder having a specific surface area, as measured by the BET method using nitrogen absorption, of not less than 30 $m^2/g$, and preferably in the range of from 50 to 400 $m^2/g$, can give good results. The fine silica powder should preferably be used in an amount of from 0.01 part to 8 parts by weight, and more preferably from 0.1 part to 5 parts by weight, based on 100 parts by weight of the toner.

In the case where the toner used in the present invention is used as a positively chargeable toner, a positively chargeable fine silica powder, rather than a negatively chargeable one, may more preferably be used also as a fine silica powder added for the purpose of preventing wear of toner or preventing contamination of carrier, since the charge stability also is not damaged. In the case where it is used as a negatively chargeable toner, a negatively chargeable fine silica powder may more preferably be used for the same reasons.

In general, the fine silica powder is negatively chargeable. As methods of obtaining the positively chargeable fine silica powder, there are a method in which the above untreated fine silica powder is treated with a silicone oil having an organo group having at least one nitrogen atom on its side chain, and a method in which it is treated with a nitrogen-containing silane coupling agent, or a method in which it is treated with both of these.

Such treating agents can be exemplified by aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyltrimethoxysilane, dibutylaminopropylmonomethoxysilane, dimethylaminophenyltriethoxysilane, trimethoxysilyl-γ-propylphenylamine and trimethoxysilyl-γ-propylbenzylamine. Besides these, they can also be exemplified by trimethoxysilyl-γ-propylpiperidine, trimethoxysilyl-γ-propylmorphorine, trimethoxysilyl-γ-propylimidazole, hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxan units per molecule and having a hydroxyl group at the terminal. Any of these compounds may be used alone or in the form of a mixture of two or more kinds. The above treating agent may preferably be used in an amount of from 1% to 40% by weight on the basis of the fine silica powder.

Fine titanium oxide powder ($TiO_2$) with a BET specific surface area of from 50 to 400 $m^2/g$ may also be used in place of the fine silica powder described above. A mixed powder of the fine silica powder and the fine titanium oxide powder may also be used.

It is also possible to add to the toner used in the developer of the present invention a fine powder of a fluorine-containing polymer as exemplified by polytetrafluoroethylene, polyvinylidene fluoride or a tetrafluoroethylene-vinylidene fluoride copolymer.

As a colorant of the toner, conventionally known dyes and/or pigments can be used. For example, carbon black, Phthalocyanine Blue, Peacock Blue, Permanent Red, Lake Red, Rhodamine Lake, Hanza Yellow, Permanent Yellow and Benzidine Yellow can be used. The colorant may be in a content of from 0.1 part to 20 parts by weight, and preferably from 0.5 part to 20 parts by weight, based on 100 parts by weight of the binder resin. In order to improve the transmission of fixed images on OHP films, it should preferably be in a content of not more than 12 parts by weight, and more preferably from 0.5 part to 9 parts by weight.

For the purpose of improving releasability at the time of heat-pressure fixing, a wax such as polyethylene, low-molecular weight polypropylene, microcrystalline wax, carnauba wax, sazole wax or paraffin wax may be added to the toner contained in the developer of the present invention. Besides the additives described above, other additives may optionally be further used in the toner used in the present invention.

The toner usable in the developer of the present invention can be produced by thoroughly mixing a vinyl type or non-vinyl type thermoplastic resin, a pigment or dye as a colorant, optionally a charge control agent and other additives by means of a mixing machine such as a ball mill, thereafter melt-kneading the mixture using a heat kneading machine such as a heat roll, a kneader or an extruder to make resins melt together, dispersing or dissolving a pigment or dye in the molten product, and solidifying it by cooling, followed by pulverization and strict classification to give toner particles. The toner particles may be used as a toner as they are. To the toner particles thus obtained, an external additive such as fine silica powder or fine titanium oxide powder may be optionally further added, where the toner particles and the external additive are mixed by means of a mixing machine such as a Henschel mixer to provide a toner. The toner having such an external additive is blended with the carrier described above, and thus can be formed into the two-component type developer of the present invention.

EXAMPLES

The present invention will be described below by giving Examples.

In the following formulation, "%" and "part(s)" refer to "% by weight" and "part(s) by weight", respectively, in all occurrences.

Example 1

A polycarbonate copolymer (crystallinity: 0.15; glass transition point: 160° C.) synthesized from bisphenol-A and exemplary compound (32) (copolymerization ratio: 20/80; weight average molecular weight: 31,000) was dissolved in a dichloroethane/trichloroethane 1/1 (weight ratio) mixed solvent in a concentration of 10% to prepare a carrier coating solution. With this solution, spherical magnetic ferrite core particles (true specific gravity: 5) with an average particle diameter of 40 μm were coated by means of Spiracoater (trade name; manufactured by Okada Seiko k.K.). The resin-coated magnetic carrier obtained after a drying step had a resin coating weight of 0.48%.

| | |
|---|---|
| Polyester resin obtained by condensation of propoxylated bisphenol with fumaric acid | 100 parts |
| Phthalocyanine pigment | 5 parts |
| Chromium complex salt of di-tert-butylsalicyclic acid | 4 parts |

The above materials were thoroughly premixed using a Henschel mixer, and the mixture was thereafter melt-kneaded three times using a three-roll mill. After cooled, the kneaded product was crushed using a hammer mill to have a particle diameter of about 1 to 2 mm. Subsequently, the crushed product was finely pulverized using a fine grinding mill of an air-jet system. The finely pulverized product obtained was then classified to give a cyan toner with a negative chargeability, having a weight average particle diameter of 8.7 μm.

Next, 100 parts of the cyan toner and 0.4 part of a fine silica powder having been made hydrophobic by treatment with hexamethyldisilazane were mixed using a Henschel mixer to give a negatively chargeable cyan toner having fine silica powder on the toner particle surfaces.

This cyan toner and the resin-coated carrier were blended in an environment of temperature/humidity of N/N (23° C./60% RH) in a toner concentration of 5% to obtain a developer. Then, 100 g of the developer thus obtained was put in a 250 cc polyethylene bottle, followed by shaking for 30 minutes using a tumbling mixer. Thereafter, the resulting developer was taken out and the developer was observed using an electron microscope. As a result, neither separation of the carrier coating resin nor toner-spent was seen.

Next, the above resin-coated carrier and cyan toner were blended to produce a two-component type developer with a toner concentration of 5%, and a running test to take copies on 20,000 copy sheets was carried out using a full-color laser copying machine CLC-500, manufactured by Canon Inc., under development contrast potential set at 350 V. As a result, as shown in Table 1, image density was stable from the initial stage of the running test up to 20,000 sheet copying, and neither fog nor black spots around images was seen. Then the developer having been used in the running test was collected to observe the state of carrier particle surfaces through an electron microscope. As a result, none of carrier deterioration such as separation of coating resin, toner-spent and so forth was seen.

Example 2

95 parts of a polycarbonate copolymer (CRYSTALLINITY: 0.1; glass transition point: 165° C.) synthesized from bisphenol-A and exemplary compound (43) (copolymerization ratio: 15/85; weight average molecular weight: 25,000) and 5 parts of isobutyl etherified melamin resin were dissolved in a dichloroethane/trichloroethane 1/1 (weight ratio) mixed solvent in a concentration of 10% to prepare a carrier coating solution. With this solution, spherical magnetic ferrite core particles (true specific gravity: 5) with an average particle diameter of 40 μm were coated by means of Spiracoater. The resin-coated magnetic carrier obtained after a drying step had a resin coating weight of 0.54%. Using this carrier and the same toner as used in Example 1, the same test as in Example 1 was made. As a result, like Example 1, good results were obtained in the shaking test and the copy running test.

Comparative Example 1

A resin-coated carrier was produced in the same manner as in Example 1 except that the polycarbonate copolymer synthesized from bisphenol-A and exemplary compound (32) (copolymerization ratio: 20/80) was replaced with bisphenol-A polycarbonate (crystallinity: 0.35). Thereafter, evaluation was made in the same manner as in Example 1. In the shaking test, the coating resin of the carrier was seen to have been separated in part, and the filming with toner was also seen. As a result of the copy running test, the reflection image density was 1.45 at the initial stage, but it increased to 1.62 after 20,000 sheet running, and deterioration due to fogging development was also seen. The developer having been used in the running test was collected to examine why these occurred. As a result, the carrier particle surfaces were seen to have been filmed with toner. The quantity of charges of the toner was also measured to reveal that it was −27.0 (μc/g), which changed by −8.2 (μc/g) with respect to the initial value. These were found to be the causes.

Comparative Example 2

Styrene/methyl methacrylate copolymer (monomer composition weight ratio: 95:5; weight average molecular weight: 45,000)

The above material was dissolved in toluene to prepare a carrier coating resin solution with a concentration of 10%. Using this solution, a resin-coated carrier was obtained in the same manner as in Example 1. Using this carrier and the same toner as used in Example 1, the same test as in Example 1 was made. In the shaking test, the coating resin of the carrier was seen to have been separated. In the copy running test, the reflection image density was seen to have decreased, and coarse images were also seen at halftone areas.

Example 3

A polycarbonate copolymer (weight average molecular weight: 36,000; crystallinity: <0.05; glass transition point: 168° C.) synthesized from homopolymer of exemplary compound (20) was dissolved in dichloroethane to prepare a carrier coating resin solution with a concentration of 10%. With this solution, spherical magnetic ferrite core particles (true specific gravity: 5) with an average particle diameter of 55 μm were coated by means of Spiracoater. The resin-coated magnetic carrier obtained after a drying step had a resin coating weight of 0.75%.

| | |
|---|---|
| Styrene/2-ethylhexyl acrylate/dimethylaminoethyl methacrylate copolymer (monomer composition weight ratio: 80:15:5) | 100 parts |
| Copper phthalocyanine | 4 parts |
| Low-molecular weight polypropylene | 5 parts |

A blue toner was prepared in the same manner as in Example 1 except for using the above materials. The blue toner obtained had a weight average particle diameter of 12.4 μm. In 100 parts of this toner, 1.0 part of positively chargeable colloidal silica having been treated with amino-modified silicone oil was mixed by means of a Henschel mixer to obtain a positively chargeable blue toner.

The positively chargeable blue toner and the above resin-coated carrier were blended in an environment of temperature/humidity of N/N (23° C./60% RH) in a toner concentration of 8% to obtain a two-component type developer. Using the developer thus obtained, the shaking test was made in the same manner as in Example 1. As a result, none of carrier deterioration such as filming with toner and separation of coating resin was seen. A developer with a toner concentration of 8% was produced in the environment of N/N, and a 20,000 sheet copy running test was carried out using a color developing machine which was a modified machine of a copying machine NP-4835, manufactured by Canon Inc. As a result, image density was stable from the initial stage up to 20,000 sheet copying, and sharp images free of fog, black spots around images or the like were obtained.

TABLE 1

| | Carrier surface observation after PE bottle shaking test | Copy running test (20,000 sheets) Reflection image density: Initial stage | After 20,000 sheets | Triboelectricity of toner (μc/g): Initial stage | After 20,000 sheets |
|---|---|---|---|---|---|
| Example: | | | | | |
| 1 | Good | 1.53 | 1.51 | −34.1 | −33.6 |
| 2 | Good | 1.48 | 1.47 | −34.8 | −34.0 |
| Comparative Example: | | | | | |
| 1 | Toner-spent Separation of coating resin | 1.45 | 1.62 | −35.2 | −27.0 |
| 2 | Separation of coating resin | 1.63 | 1.33 | −27.8 | −41.2 |
| Example: | | | | | |
| 3 | Good | 1.31 | 1.29 | +18.5 | +18.0 |

Example 4

Polycarbonate-polydimethylsiloxane block copolymer having the following structural formula (Mw: 20,000; crystallinity: 0.24) 20.0%

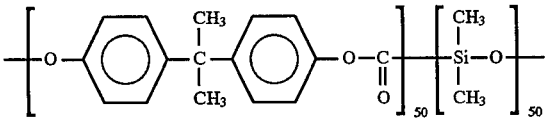

Magnetic fine ferrite particles (average particle diameter: 0.32 μm) 80.0%

The above materials were thoroughly premixed using a Henschel mixer, and the mixture was thereafter melt-kneaded three times using a three-roll mill. After cooled, the kneaded product was crushed using a hammer mill to have a particle diameter of about 1 to 2 mm. Subsequently, the crushed product was finely pulverized using a fine grinding mill of an air-jet system, to obtain a magnetic material dispersed type carrier.

Physical properties of the magnetic material dispersed type carrier thus obtained are shown in Table 2.

Meanwhile, a negatively chargeable cyan toner with a weight average particle diameter of 8.4 μm was prepared in the same manner as in Example 1.

Next, 100 parts of the cyan toner and 0.4 part of a fine silica powder having been made hydrophobic by treatment with hexamethyldisilazane were mixed using a Henschel mixer to obtain a negatively chargeable cyan toner having fine silica powder on the toner particle surfaces.

The negatively chargeable cyan toner and the above carrier were blended in an environment of temperature/humidity of N/N (23° C./60% RH) in a toner concentration of 10% to obtain a two-component type developer. Next, 100 g of the developer thus obtained was put in a 250 cc polyethylene bottle, followed by shaking for 1 hour using a tumbling mixer. Thereafter, this developer was taken out and the developer was observed using an electron microscope. As a result, no filming with the toner and so forth were seen. Neither falling-off nor burying of external additives of the toner was also seen.

The negatively chargeable cyan toner and the above resin-coated carrier were blended in an environment of temperature/humidity of L/L (15° C./10% RH) in a toner concentration of 8% to obtain a two-component type developer. In the same environment, this developer was put in a developing assembly used for a full-color laser copying machine CLC-500, manufactured by Canon Inc., and unloaded drive was continued for 20 minutes by external motor driving (peripheral speed: 200 rpm). Thereafter, using a modified machine of CLC-500, images were reproduced in an environment of normal temperature and normal humidity. In the modified machine, the distance between the developing sleeve and the developer regulating member was 400 μm, and the ratio of the peripheral speed of the developing sleeve to that of the photosensitive drum was 1.3:1. Development was carried out under conditions of a developing pole magnetic field intensity of 1,000 oersteds, an alternating electric field of 2,000 Vpp and a frequency of 3,000 Hz, where the distance between the developing sleeve and the photosensitive drum was 500 μm.

As a result of the image reproduction test made under the above conditions, images at the initial stage showed a sufficiently high density also in respect of solid images, and sharp images free of fog at non-image areas and coarseness at halftone areas were also obtained. Image reproduction was tested after the unloaded drive. As a result, good results free of coarse images at halftone areas were obtained.

Results obtained are shown in Table 3.

Example 5

A two-component type developer was produce in the same manner as in Example 4 except that the carrier particles produced in Example 4 were covered on their surfaces with resin coating layers having the composition shown below. Physical properties of this carrier are shown in Table 2.

This developer was evaluated in the same manner as in Example 4. As a result, no filming with the toner and so forth were seen. Neither falling-off nor burying of external additives of the toner was also seen. Good results were also obtained in the image reproduction tested on the color laser copying machine CLC-500. The results are shown in Table 3.

Styrene/2-ethylhexyl methacrylate (40/60) copolymer Mw/Mn: 2.9; Mw: 42,000 (resin coating weight: 0.8%; solvent: toluene)

Example 6

Polycarbonate-polydimethylsiloxane block copolymer having the following structural formula (Mw: 30,000; crystallinity: 0.25; glass transition point: 140° C.)

20.0%

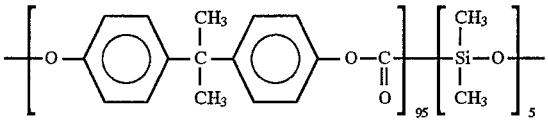

Magnetic rdduced iron particles (average particle diameter: 0.32 μm) 80.0%

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of 50 μm. The finely pulverized product was introduced in Mechanomill MM-10 (trade name; manufactured by Okada Seiko K.K.) to mechanically make the particles spherical. The finely pulverized particles made spherical were then classified to obtain spherical magnetic carrier core particles. Physical properties of the carrier thus obtained are shown in Table 2.

Using the carrier obtained, the same test as in Example 4 was carried out. As a result, like Example 4, good results were obtained in the shaking test and the image reproduction test. The results are shown in Table 3.

Example 7

A two-component type developer was produce in the same manner as in Example 4 except that the carrier particles produced in Example 6 were covered on their surfaces with resin coating layers having the composition shown below. Physical properties of this carrier are shown in Table 2.

This developer was evaluated in the same manner as in Example 4. As a result, no filming with the toner and so forth were seen. Neither falling-off nor burying of external additives of the toner was also seen. Good results were also obtained in the image reproduction tested on the color laser copying machine CLC-500. The results are shown in Table 3.

Styrene/2-ethylhexyl methacrylate copolymer (copolymerization weight ratio: 40/60) Mw/Mn: 2.9; Mw: 42,000 (resin coating weight: 0.8%; solvent: toluene)

Example 8

Polycarbonate-polydimethylsiloxane block copolymer having the following structural formula (Mw: 45,000)

20.0%

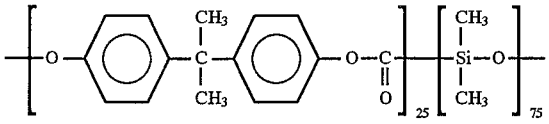

Magnetic fine magnetite particles (average particle diameter: 0.26 μm) 80.0%

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of 50 μm. The finely pulverized product was introduced in Mechanomill MM-10 (trade name; manufactured by Okada Seiko K.K.) to mechanically make the particles spherical. The finely pulverized particles made spherical were then classified to obtain spherical carrier core particles. The carrier particles thus obtained had an average particle diameter of 54 μm. Physical properties of the carrier thus obtained are shown in Table 2.

Using the carrier obtained, the same test as in Example 4 was carried out. As a result, like Example 4, good results were obtained in the shaking test and the image reproduction test. The results are shown in Table 3.

Example 9

A coated carrier was produce in the same manner as in Example 4 except that the carrier particles produced in Example 8 were covered on their surfaces with resin coating layers having the composition shown below. Physical properties of this coated carrier are shown in Table 2.

This developer was evaluated in the same manner as in Example 4. As a result, no filming with the toner and so forth were seen. Neither falling-off nor burying of external additives of the toner was also seen. Good results were also obtained in the image reproduction tested on the color laser copying machine CLC-500. The results are shown in Table 3.

Styrene/phenyl acrylate copolymer (copolymerization weight ratio: 50/50) Mw/Mn: 4.5; Mw: 56,000 (resin coating weight: 1.2%; solvent: toluene)

Comparative Example 3

Using reduced iron particles of 43 μm in place of the carrier core particles used in Example 4, the reduced iron particles were coated with the coating resin used in Example 5, in a coating weight of 0.8%. Physical properties of the coated carrier thus obtained are shown in Table 2.

Using this carrier, the same measurement and tests as in Example 4 were made. As a result of the shaking test, the carrier had no difference from the one before shaking, but the burying of external additives on toner surfaces was a little seen. As a result of the image reproduction test, coarse images were seen particularly at halftone areas. The results are shown in Table 3.

TABLE 2

| | Carrier true specific gravity | Magnetic material σs (emu/g) | Carrier particle diameter (μm) | Carrier specific resistance (Ω · cm) | Magnetic material | Remarks |
|---|---|---|---|---|---|---|
| Example: | | | | | | |
| 4 | 3.2 | 85 | 47 | $2 \times 10^{11}$ | Ferrite | X |
| 5 | 3.2 | 85 | 48 | $3 \times 10^{11}$ | " | Y |
| 6 | 3.5 | 139 | 48 | $3 \times 10^{10}$ | Reduced iron | X |
| 7 | 3.5 | 139 | 48 | $1 \times 10^{11}$ | Reduced iron | Y |
| 8 | 3.0 | 83 | 54 | $5 \times 10^{8}$ | Magnetite | X |
| 9 | 3.0 | 83 | 54 | $4 \times 10^{11}$ | " | Y |

TABLE 2-continued

| | Carrier true specific gravity | Magnetic material σs (emu/g) | Carrier particle diameter (μm) | Carrier specific resistance (Ω · cm) | Magnetic material | Remarks |
|---|---|---|---|---|---|---|
| Comparative Example: | | | | | | |
| 3 | 7.8 | 139 | 43 | $1 \times 10^{11}$ | Reduced iron | Y |

X: No resin-coated
Y: Resin-coated

TABLE 3

| | Carrier surface | SEM observation after | Image reproduction test after L/L unloaded drive | |
|---|---|---|---|---|
| | SEM observation | PE bottle shaking test | Solid image | Halftone image |
| Example: | | | | |
| 4 | AA | AA | AA | AA |
| 5 | AA | A | AA | A |
| 6 | AA | AA | AA | AA |
| 7 | A | A | AA | A |
| 8 | AA | AA | AA | AA |
| 9 | A | A | AA | A |
| Comparative Example: | | | | |
| 3 | A | C*1 | B | C*2 |

- Evaluation criterion -
AA: Excellent, A: Good, B: Passable, C: Failure
*1 External additive of toner buried.
*2 Coarse.

Example 10

15 parts of polycarbonate-polydimethylsiloxane block copolymer having the following structural formula (Mw: 25,000; crystallinity: 0.24);

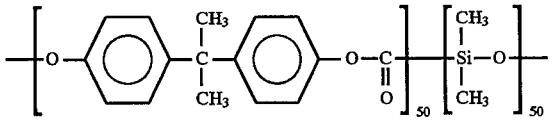

was dissolved in 85 parts of tetrahydrofuran to formulate a carrier coating solution. With this solution, spherical magnetic ferrite core particles with an average particle diameter of 45 μm were coated by means of Spiracoater. The coated particles were predried at a temperature of 80° C. for 20 minutes, followed by drying at a temperature of 150° C. for 40 minutes to obtain a resin-coated carrier. The resin-coated magnetic carrier obtained after the drying step had a resin coating weight of 0.93%.

A negatively chargeable cyan toner with a weight average particle diameter of 8.3 μm was prepared in the same manner as in Example 1.

Next, 100 parts of the cyan toner and 0.4 part of a fine silica powder having been made hydrophobic by treatment with hexamethyldisilazane were mixed using a Henschel mixer to obtain a negatively chargeable cyan toner having fine silica powder on the toner particle surfaces.

This cyan toner and the above resin-coated magnetic carrier were blended in an environment of temperature/humidity of N/N (23° C./60% RH) in a toner concentration of 10% to obtain a two-component type developer. Next, 100 g of the developer thus obtained was put in a 250 cc polyethylene bottle, followed by shaking in an environment of normal temperature and normal humidity for 1 hour using a tumbling mixer. Thereafter, this developer was taken out and the developer was observed using an electron microscope. As a result, no filming on the carrier with the toner was seen.

This developer was also tested for image reproduction by the use of a modified machine of a full-color laser copying machine manufactured by Canon Inc. At this time, the distance between the developing sleeve and the developer regulating member was 400 μm, and the ratio of the peripheral speed of the developing sleeve to that of the photosensitive drum was 1.3:1. Development was carried out under conditions of a developing pole magnetic field intensity of 1,000 oersteds, an alternating electric field of 2,000 Vpp and a frequency of 3,000 Hz, where the distance between the developing sleeve and the photosensitive member was 500 μm.

As a result of the image reproduction test made under the above conditions, solid images showed a sufficiently high density, and sharp images free of fog at non-image areas and coarseness at halftone areas were also obtained. The results are shown in Table 4.

Example 11

Using polycarbonate-polydimethylsiloxane block copolymer having the following structural formula (Mw: 15,000; crystallinity: 0.25; glass transition point: 140° C.);

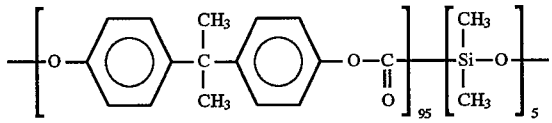

a carrier was prepared in the same manner as in Example 10. The resin-coated magnetic carrier obtained had a resin coating weight of 0.95%.

Evaluation was made on this carrier in the same manner as in Example 10. As a result, good results were obtained. The results obtained are shown in Table 4.

Example 12

Using polycarbonate-polydimethylsiloxane block copolymer having the following structural formula (Mw: 45,000);

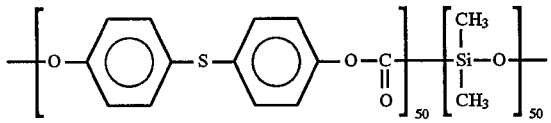

a carrier was prepared in the same manner as in Example 10. The resin-coated magnetic carrier obtained after the drying step had a resin coating weight of 0.91%.

Evaluation was made on this carrier in the same manner as in Example 10. As a result, good results were obtained. The results obtained are shown in Table 4.

Example 13

Using polycarbonate-polydimethylsiloxane block copolymer having the following structural formula (Mw: 30,000; crystallinity: 0.20;

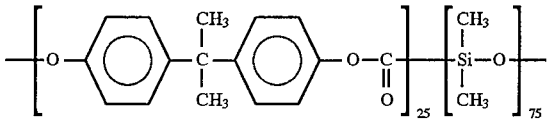

a carrier was prepared in the same manner as in Example 10, and evaluation was made in the same manner similarly. As a result, good results were obtained. The results obtained are shown in Table 4.

Example 14

15 parts of polycarbonate-polydimethylsiloxane block copolymer having the following structural formula (Mw: 25,000);

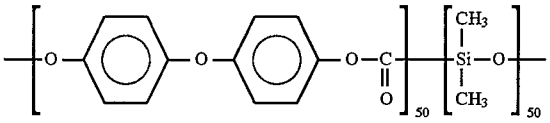

was dissolved in 85 parts of tetrahydrofuran to formulate a carrier coating solution. With this solution, spherical ferrite core particles with an average particle diameter of 50 μm having been treated with methyltrimethoxysilane were coated by means of Spiracoater. The coated particles were predried at a temperature of 80° C. for 20 minutes, followed by drying at a temperature of 150° C. for 40 minutes to obtain a resin-coated carrier. The resin-coated carrier obtained after the drying step had a resin coating weight of 0.93%.

Evaluation was made on this carrier in the same manner as in Example 10. As a result, good results were obtained. The results obtained are shown in Table 4.

Example 15

15 parts of polycarbonate-polydimethylsiloxane block copolymer having the following structural formula (Mw: 28,000);

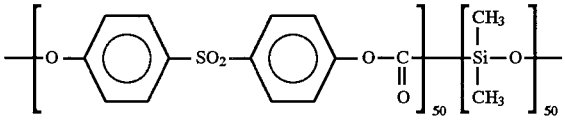

and 1 part of methyltrimethoxysilane were dissolved in 85 parts of dioxan to formulate a carrier coating solution. With this solution, spherical ferrite core particles with an average particle diameter of 48 μm were coated by means of Spiracoater. The coated particles were predried at a temperature of 80° C. for 20 minutes, followed by drying at a temperature of 150° C. for 40 minutes to obtain a resin-coated carrier. The resin-coated carrier obtained after the drying step had a resin coating weight of 0.90%.

Evaluation was made on this carrier in the same manner as in Example 10. As a result, good results were obtained. The results obtained are shown in Table 4.

Example 16

15 parts of polycarbonate-polydimethylsiloxane block copolymer having the following structural formula (Mw: 25,000);

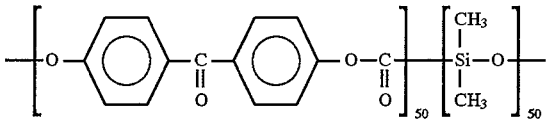

and 1 part of methyltrimethoxysilane were dissolved in 85 parts of tetrahydrofuran to formulate a carrier coating solution. With this solution, spherical ferrite core particles with an average particle diameter of 45 μm were coated by means of Spiracoater. The coated particles were predried at a temperature of 80° C. for 20 minutes, followed by drying at a temperature of 150° C. for 40 minutes to obtain a resin-coated carrier. The resin-coated carrier obtained after the drying step had a resin coating weight of 0.96%.

Evaluation was made on this carrier in the same manner as in Example 10. As a result, good results were obtained. The results obtained are shown in Table 4.

Example 17

15 parts of polycarbonate-polydimethylsiloxane block copolymer having the following structural formula (Mw: 20,000; crystallinity: 0.24);

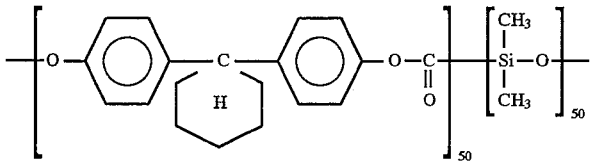

and 1 part of methyltrimethoxysilane were dissolved in 85 parts of chlorobenzene to formulate a carrier coating solution. With this solution, amorphous iron powder particles with an average particle diameter of 100 μm were coated by means of Spiracoater. The coated particles were predried at a temperature of 80° C. for 20 minutes, followed by drying at a temperature of 170° C. for 40 minutes to obtain a resin-coated carrier. The resin-coated carrier obtained after the drying step had a resin coating weight of 0.91%.

This carrier and a toner for NP-5000, manufactured by Canon Inc., were blended (toner concentration: 2%) to obtain a two-component type developer. Next, 100 g of the developer thus obtained was put in a 250 cc polyethylene bottle, followed by shaking in an environment of normal temperature and normal humidity for 1 hour using a tumbling mixer. Thereafter, this developer was taken out and the developer was observed using an electron microscope. As a result, no filming on the carrier with the toner was seen. This developer was also tested for image reproduction by the use of a modified machine of NP-5000, so modified that a high-resistance carrier was usable in an environment of normal temperature and normal humidity. As a result, sharp images free of fog at non-image areas were obtained. The results are shown in Table 4.

TABLE 4

| | | Initial image reproduction | |
|---|---|---|---|
| | Shaking test Anti-filming | Solid density | Halftone coarseness |
| Example: | | | |
| 10 | AA | AA | AA |
| 11 | AA | AA | AA |
| 12 | AA | A | AA |

TABLE 4-continued

| | Shaking test Anti-filming | Initial image reproduction Solid density | Halftone coarseness |
|---|---|---|---|
| 13 | A | AA | AA |
| 14 | A | AA | AA |
| 15 | A | AA | A |
| 16 | AA | A | A |
| 17 | AA | AA | AA |

- Evaluation criterion -
AA: Excellent, A: Good, B: Passable, C: Failure

Example 18

| | |
|---|---|
| Polycarbonate copolymer (crystallinity: 0.20; weight average molecular weight: 31,000; glass transition point: 160° C.) synthesized from bisphenol-A and exemplary compound (20) (copolymerization ratio: 25/75) | 15% |
| Magnetite (average particle diameter: 0.24 μm) | 85% |

The above materials were thoroughly premixed using a Henschel mixer, and the mixture was thereafter melt-kneaded at least twice using a three-roll mill. After cooled, the kneaded product was crushed using a hammer mill to have a particle diameter of about 2 mm. Subsequently, the crushed product was finely pulverized using a fine grinding mill of an air-jet system to have a particle diameter of 48 μm, followed by sieving to obtain a magnetic material dispersed type carrier with an average particle diameter of 47 μm.

The cyan toner as used in Example 1 and the above carrier were blended in an environment of temperature/humidity of N/N (23° C./60% RH) in a toner concentration of 5% to obtain a two-component type developer. Next, 100 g of the developer thus obtained was put in a 250 cc polyethylene bottle, followed by shaking for 30 minutes using a tumbling mixer. Thereafter, this developer was taken out and the developer was observed using an electron microscope. As a result, none of carrier deterioration such as carrier size reduction, separation of magnetic material from carrier particles and toner spent was seen. Neither falling-off nor burying of external additives of the toner was seen.

Next, the above carrier and toner were blended in an environment of temperature/humidity of N/N (23° C./60% RH) in a toner concentration of 5% to obtain a two-component type developer. Using this developer and in the same environment, a 30,000 sheet copy running test was carried out using a modified machine of a full-color laser copying machine CLC-500, manufactured by Canon Inc. As a result, solid image density was sufficiently high and also stable from the initial stage up to 30,000 sheet copying, and images with a good reproduction at halftone areas and a high minuteness were obtained. To also evaluate the durability of the carrier, the carrier having been used in the 30,000 sheet running was collected to observe its state through an electron microscope. As a result, none of carrier size reduction, toner spent and separation of magnetic material from carrier particles were seen.

Example 19

| | |
|---|---|
| Polycarbonate copolymer (crystallinity: 0.10) synthesized from bisphenol-A and exemplary compound (1) (copolymerization ratio: 15/85) | 10% |
| Styrene/methyl methacrylate/methyl acrylate copolymer (monomer composition weight ratio: 50:40:10) | 10% |
| Magnetite | 80% |

The above materials were thoroughly premixed using a Henschel mixer, and the mixture was thereafter melt-kneaded at least twice using a three-roll mill. After cooling, the kneaded product was crushed using a hammer mill to have a particle diameter of about 2 mm. Subsequently, the crushed product was finely pulverized using a fine grinding mill of an air-jet system to have a particle diameter of 48 μm, followed by sieving to obtain a magnetic material dispersed type carrier with an average particle diameter of 49 μm. Using this carrier and the toner as used in Example 1, the same test as in Example 18 was carried out. As a result, the same good results as in Example 18 were obtained.

TABLE 5

| | Carrier surface observation after PE bottle shaking test | Copy running test: Reflection image density Initial stage | After 30,000 sheets | Triboelectricity of toner (μc/g) Initial stage | After 30,000 sheets |
|---|---|---|---|---|---|
| Example: | | | | | |
| 18 | Good | 1.50 | 1.53 | −29.4 | −29.1 |
| 19 | Good | 1.52 | 1.55 | −29.0 | −28.6 |

What is claimed is:

1. A carrier for use in electrophotography, comprising: a magnetic material and a resin;

said resin comprising a polycarbonate resin having a crystallinity of 0.25 or less, said polycarbonate resin being selected from the group consisting of a copolymer (A) and a copolymer (B), wherein said copolymer (A) has the following two component units

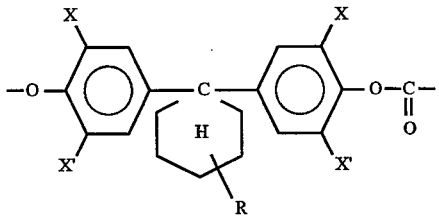

(IIa)

wherein X and X' each represent a hydrogen atom, a halogen atom or a methyl group; R represents a hydrogen atom, a halogen atom, a hydroxyl group, a carboxyl group, an acetyl group or an alkyl group having 1 to 4 carbon atoms, and

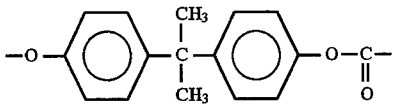

and said copolymer (B) has the following two component unit

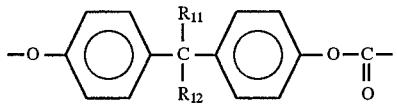

(IIIa)

wherein $R_{11}$ and $R_{12}$ are different from each other and each represents an alkyl group or an aromatic group, and

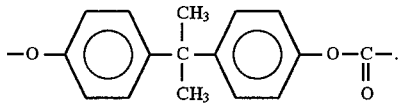

2. The carrier according to claim 1, wherein carrier core particles are coated with said resin.

3. The carrier according to claim 2, wherein said carrier core particles comprise said magnetic material.

4. The carrier according to claim 2, wherein said carrier core particles are coated with said polycarbonate resin in a coating weight of from 0.05% by weight to 30% by weight based on the total carrier.

5. The carrier according to claim 2, wherein said carrier core particles are coated with said polycarbonate resin in a coating weight within the following range /2Z≦coating weight≦50/Z % by total weight of carrier wherein Z represents a specific gravity of the carrier core particles.

6. The carrier according to claim 5, wherein said carrier core particles are coated with said polycarbonate resin in a coating weight within the following range 1/Z≦coating weight≦25/Z % by total weight of carrier wherein Z represents a specific gravity of the carrier core particles.

7. The carrier according to claim 1, wherein said polycarbonate resin has a crystallinity of 0.20 or less.

8. The carrier according to claim 1, wherein said polycarbonate resin is a copolymer having the following two component units:

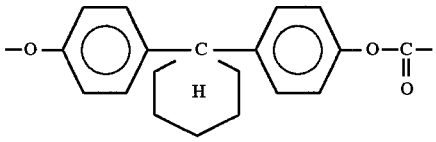

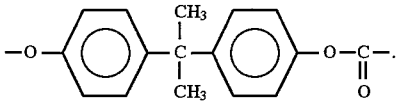

9. The carrier according to claim 1, wherein said polycarbonate resin is a copolymer have the following two component units:

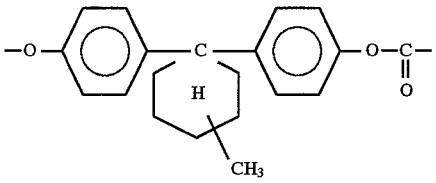

-continued

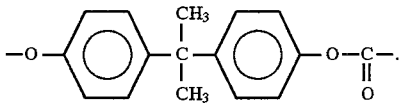

10. The carrier according to claim 1, wherein said polycarbonate resin is a copolymer having the following component units:

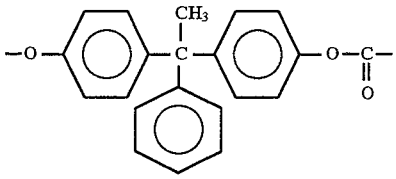

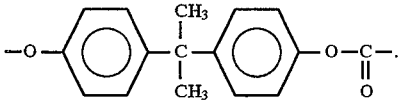

11. The carrier according to claim 1, wherein said polycarbonate resin has a weight average molecular weight of from 10,000 to 50,000.

12. A two-component developer for developing an electrostatic image, comprising: a toner and a carrier; said carrier comprising a magnetic material and a resin;

said resin comprising a polycarbonate resin having a crystallinity of 0.25 or less, said polycarbonate resin being selected from the group consisting of a copolymer (A) and a copolymer (B), wherein said copolymer (A) has the following two components units

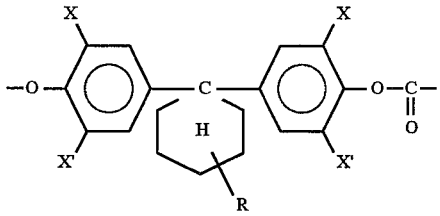

(IIa)

wherein X and X' each represent a hydrogen atom, a halogen atom or a methyl group; R represents a hydrogen atom, a halogen atom, a hydroxyl group, a carboxyl group, an acetyl group or an alkyl group having 1 to 4 carbon atoms, and

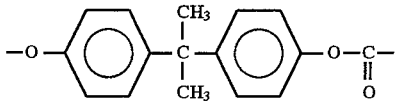

and said copolymer (B) has the following two component units

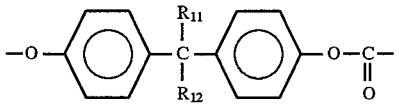

(IIIa)

wherein $R_{11}$ and $R_{12}$ are different from each other and each represents an alkyl group or an aromatic group, and

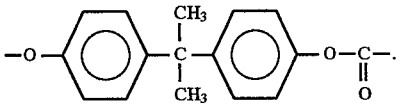

13. The developer according to claim 12, wherein carrier core particles are coated with said resin.

14. The developer according to claim 13, wherein said carrier core particles comprise said magnetic material.

15. The developer according to claim 13, wherein said carrier core particles are coated with said polycarbonate resin in a coating weight of from 0.05% by weight to 30% by weight based on the tatal carrier.

16. The developer according to claim 13, wherein said carrier core particles are coated with said polycarbonate resin in a coating weight within the following range $1/2Z \leqq$ coating weight $\leqq 50/Z$ % by total weight of carrier wherein Z represents a specific gravity of the carrier core particles.

17. The developer according to claim 16, wherein said carrier core particles are coated with said polycarbonate resin in a coating weight within the following range $1/Z \leqq$ coating weight $\leqq 25/Z$ % by total weight of carrier wherein Z represents a specific gravity of the carrier core particles.

18. The developer according to claim 13, wherein said toner is incorporated with a fine silica powder externally added.

19. The developer according to claim 12, wherein said polycarbonate resin has a crystallinity of 0.20 or less.

20. The developer according to claim 12, wherein said polycarbonate resin is a copolymer having the following two component units:

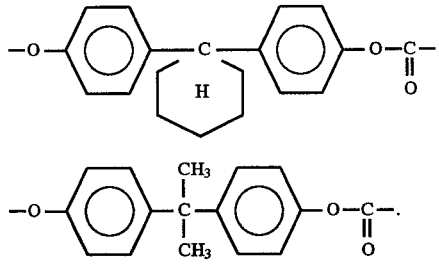

21. The developer according to claim 12, wherein said polycarbonate resin is a copolymer having the following two component units:

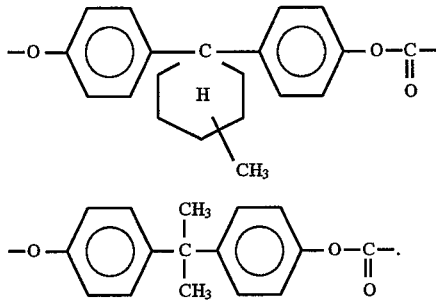

22. The developer according to claim 12, wherein said polycarbonate resin is a copolymer having the following two component units:

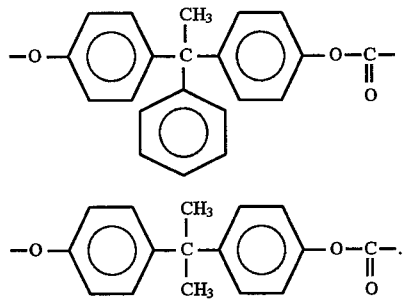

23. The developer according to claim 12, wherein said polycarbonate resin has a weight average molecular weight of from 10,000 to 50,000.

24. The developer according to claim 12, wherein said toner has a weight average particle diameter of from 1 μm to 20 μm.

25. The developer according to claim 12, wherein said toner has a weight average particle diameter of from 4 μm to 13 μm.

26. The developer according to claim 12, wherein said toner is incorporated with a fine titanium oxide powder externally added.

* * * * *

UNITED STATES PATENT AND TRADEMARK OFFICE

CERTIFICATE OF CORRECTION

PATENT NO. : 5,624,778

DATED : April 29, 1997

INVENTOR(S) : YUKOH SATO ET AL.

It is certified that error appears in the above-identified patent and that said Letters Patent is hereby corrected as shown below:

COLUMN 1

Line 38, "Given" should read --given--.

COLUMN 2

Line 66, "about a" should read --about--.

COLUMN 6

Line 32, "our" should read --out--.

COLUMN 12

Line 11, "represents" should read --represent--.

COLUMN 17

Line 31, "cooled," should read --cooling,--.

COLUMN 23

Line 49, "(CRYSTALLINITY:" should read --(crystallinity:--.

COLUMN 25

Line 49, "cooled," should read --cooling,--.

UNITED STATES PATENT AND TRADEMARK OFFICE

CERTIFICATE OF CORRECTION

PATENT NO. : 5,624,778

DATED : April 29, 1997

INVENTOR(S) : YUKOH SATO ET AL.

It is certified that error appears in the above-identified patent and that said Letters Patent is hereby corrected as shown below:

COLUMN 26

Line 44, "produce" should read --produced--.

COLUMN 27

Line 9, "rdduced" should read --reduced--.
Line 32, "produce" should read --produced--.
Line 67, "cooled," should read --cooling,--.

COLUMN 28

Line 19, "produce" should read --produced--.

COLUMN 33

Line 29, "cooled," should read --cooling,--.

COLUMN 34

Line 67, "unit" should read --units--.

COLUMN 35

Line 27, "12Z≤ coating" should read --$^1/_2$Z≤ coating--.
Line 56, "have" should read --having--.

COLUMN 36

Line 8, "following" should read --following two--.
Line 36, "ponents" should read --ponent--.

UNITED STATES PATENT AND TRADEMARK OFFICE

CERTIFICATE OF CORRECTION

PATENT NO. : 5,624,778

DATED : April 29, 1997

INVENTOR(S) : YUKOH SATO ET AL.

It is certified that error appears in the above-identified patent and that said Letters Patent is hereby corrected as shown below:

COLUMN 37

Line 14, "tatal" should read --total--.

Signed and Sealed this

Twenty-fifth Day of November, 1997

*Attest:*

*Attesting Officer*

BRUCE LEHMAN

*Commissioner of Patents and Trademarks*